US005168033A

United States Patent [19]

Takada et al.

[11] Patent Number: 5,168,033

[45] Date of Patent: * Dec. 1, 1992

[54] COLOR PHOTOGRAPHIC MATERIAL WITH LOW $O_2$ PERMEABLE SUPPORT AND GELATION OVERCOAT

[75] Inventors: Shun Takada; Kaoru Onodera, both of Odawara, Japan

[73] Assignee: Konica Corporation, Tokyo, Japan

[ * ] Notice: The portion of the term of this patent subsequent to Nov. 18, 2003 has been disclaimed.

[21] Appl. No.: 579,267

[22] Filed: Sep. 6, 1990

Related U.S. Application Data

[63] Continuation of Ser. No. 266,242, Oct. 28, 1988, abandoned, which is a continuation of Ser. No. 103,846, Oct. 1, 1987, abandoned, which is a continuation of Ser. No. 814,225, Dec. 27, 1985, abandoned.

[30] Foreign Application Priority Data

Dec. 29, 1984 [JP] Japan ..... 59-276725

[51] Int. Cl.[5] ..... G03C 7/38; G03C 1/76

[52] U.S. Cl. ..... 430/533; 430/531; 430/536; 430/539; 430/551; 430/558; 430/961

[58] Field of Search ..... 430/531, 533, 536, 539, 430/372, 551, 558, 961

[56] References Cited

U.S. PATENT DOCUMENTS

| | | | |
|---|---|---|---|
| 3,725,067 | 4/1973 | Bailey et al. | 430/558 |
| 4,283,486 | 8/1981 | Aono et al. | 430/558 |
| 4,540,654 | 9/1985 | Sato et al. | 430/558 |
| 4,548,899 | 10/1985 | Nakayama et al. | 430/558 |
| 4,585,732 | 4/1986 | Kawagishi et al. | 430/558 |
| 4,594,313 | 6/1986 | Furutachi et al. | 430/558 |
| 4,623,617 | 11/1986 | Kaneko | 430/558 |
| 4,675,275 | 6/1987 | Nishijima et al. | 430/558 |
| 4,675,280 | 6/1987 | Kaneko et al. | 430/558 |

*Primary Examiner*—Richard L. Schilling
*Attorney, Agent, or Firm*—Jordan B. Bierman

[57] ABSTRACT

A silver halide photographic material having at least one silver halide emulsion layer formed on a base is disclosed said base is a reflective base having an oxygen permeability of no more than 2.0 ml/m$^2$.hr.atm, at least one of said silver halide emulsion layers is a magenta dye forming layer containing at least one magenta coupler of formula (I) shown below, and the layers positioned above said silver halide emulsion layer with respect to said base have a gelatin content of no less than 3 g/m$^2$:

(I)

wherein Z represents a group of the non-metallic atoms necessary for forming a nitrogen-containing heterocyclic ring, provided that the ring formed by Z may have a substituent; X represents a hydrogen atom or a substituent capable of being eliminated upon reaction with the oxidation product of a color developing agent; and R is a hydrogen atom or a substituent.

8 Claims, No Drawings

COLOR PHOTOGRAPHIC MATERIAL WITH LOW $O_2$ PERMEABLE SUPPORT AND GELATION OVERCOAT

This application is a continuation of U.S. application Ser. No. 266,242, filed Oct. 28, 1988; which is a continuation of U.S. application Ser. No. 07/103,846, filed Oct. 1, 1987; which is a continuation of U.S. application Ser. No. 814,225, filed Dec. 27, 1985, all now abandoned.

FIELD OF THE INVENTION

The present invention relates to a silver halide photographic material that forms color by coupling with the oxidation product of an aromatic primary amino developing agent. More particularly, the present invention relates to a silver halide color photographic material for prints having a high degree of light fastness.

BACKGROUND OF THE INVENTION

The mechanism behind the formation of a dye image in a silver halide color photographic material is as follows: an aromatic primary amino color developing agent reduces silver halide grains in the exposed photographic material; at the same time, the developing agent is oxidized and the resulting oxidation product reacts with a built-in coupler to form a dye. Since color reproduction depends on the substractive process, three couplers are customarily used to form yellow, magenta and cyan dyes.

Magenta dye images are formed by 5-pyrazolone, cyano-acetopnenone, indazolone, pyrazolobenzimidazole and pyrazolotriazole couplers. Most of the magenta dye image forming couplers used commercially today are 5-pyrazolone compounds. The dye image formed from the 5-pyrazolone couplers have high resistance to both light and heat but, on the other hand, the image does not exhibit a satisfactory color tone and presents an unwanted absorption in the yellow component around 430 nm. Furthermore, the relatively long tail at the long wavelength side causes color contamination. Because of these defects in spectral absorption characteristics, the color dye image resulting from the 5-pyrazolone couplers lacks brightness.

This has presented a particularly serious problem for direct viewing color prints wherein the image is supported on a reflective base. Couplers from which unwanted absorptions are eliminated have been proposed and those described in U.S. Pat. No. 3,725,067, Unexamined Published Japanese Patent Application Nos. 99437/1984, 162548/1984, 171956/1984, Research Disclosure Nos. 24220, 24230 and 24531 have excellent performance. However, the dye images formed from these couplers have a very low degree of light fastness, and if they are incorporated in photographic materials for direct viewing prints, the essential needs of photographic materials for recording and preserving images cannot be satisfied.

With a view to improving the light fastness of color images formed from 1H-pyrazolo[5,1-c]-1,2,4-triazole type couplers, Unexamined Published Japanese Patent Application No. 125732/1984 and Research Disclosure No. 24531 proposed the use of a pholic or phenol ester antioxidant. However, these compounds will often cause color changes and fogging and do not have satisfactory physical properties with respect to dispersibility and crystallization. In addition, these compounds are not completely effective against discoloration and hence fail to provide color images having the desired light fastness.

Oxygen is known to be one of the causes for deterioration of the light fastness of color dye images, and it has been proposed that improved light fastness can be achieved by isolating the color dye image from oxygen. For example, Unexamined Published Japanese Patent Application Nos. 11330/1974 and 57223/1975 describe methods for enclosing the color dye image with an oxygen blocking layer made of a material with low oxygen permeability (e.g., by laminating the image with a polyester layer). These methods are effective to some extent but are far from being satisfactory in that the light fastness of the image formed from certain couplers is deteriorated rather than improved. An additional disadvantage is the increase in the number of steps involved, which makes the overall process complicated and costly.

SUMMARY OF THE INVENTION

One object, therefore, of the present invention is to provide a reflection silver halide photographic material capable of providing a magenta dye image having improved light fastness.

Another object of the present invention is to provide a silver halide color photographic material capable of forming a bright dye image wherein the magenta dye has superior spectral absorption characteristics and which exhibits a good color tone and allows for a broad color reproduction region.

These objects of the present invention can be achieved by a silver halide photographic material having at least silver halide emulsion layer on a base, said base being a reflective base having an oxygen permeability of not higher than 2.0 $ml/m^2.hr.atm$, at least one of said silver halide emulsion layers containing at least one magenta coupler of formula (I) given below, and the layers positioned above said silver halide emulsion layer with respect to said base having a gelatin content of 3 $g/m^2$ or more.

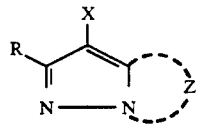

(I)

where Z represents a group of the non-metallic atoms necessary for forming a nitrogen-containing heterocyclic ring, provided that the ring formed by Z may have a substituent; X represents a hydrogen atom or a substituent capable of being eliminated upon reaction with the oxidation product of a color developing agent; and R is a hydrogen atom or a substituent.

DETAILED DESCRIPTION OF THE INVENTION

In the magenta coupler of formula (I), the substituent represented by R includes, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridged hydrocarbon compound residue, an alkoxy group, an aryloxy group, a heterocyclicoxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

The halogen atom includes, for example, chlorine and bromine atoms, the chlorine atom being particularly preferable.

The alkyl group represented by R is preferably one having 1 to 32 carbon atoms, the alkenyl group and the alkinyl group are preferably those having 2 to 32 carbon atoms, and the cycloalkyl group and the cycloalkenyl group are preferably those having 3 to 12, particularly 5 to 7, carbon atoms, the alkyl, alkenyl and alkinyl groups each including those having a straight or branched chain.

These alkyl, alkenyl, alkinyl, cycloalkyl and cycloalkenyl groups each may have one or more substituents. Such substituents include, in addition to an aryl group, a cyano group, a halogen atom, a heterocyclic group, a cycloalkyl group, a cycloalkenyl group, a spiro-compound residue and a bridged hydrocarbon compound residue, for example, those substituted through the carbonyl group, such as acyl, carboxy, carbamoyl, alkoxycarbonyl and aryloxycarbonyl groups, and those substituted through the hetero atom, for example, those substituted through the oxygen atom, such as hydroxy, alkoxy, aryloxy, heterocyclicoxy, siloxy, acyloxy and carbamoyloxy groups, those substituted through the nitrogen atom, such as nitro, amino (including dialkylamino and the like), sulfamonylamino, alkoxycarbonylamino, aryloxycarbonylamino, acylamino, sulfoneamido, imido and ureido groups, those substituted through the sulfur atom, such as alkylthio, arylthio, heterocyclicthio, sulfonyl, sulfinyl and sulfamoyl groups, and those substituted through the phosphorus atom, such as a phosphonyl group and the like.

Examples of the alkyl group represented by R include, for example, methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenylisopropyl, 3-m-butanesulfonaminophenoxypropyl, 3,4'-{α-[4''(p-hydroxybenzenesulfonyl)phenoxy]dodecanoylamino} phenylpropyl, 3-{4'-[α-(2'',4''-di-t-amylphenoxy)-butaneamido]-phenyl}-propyl, 4-[a-(O-chlorophenoxy)-tetradecanamidophenoxy]-propyl, allyl, cyclopentyl and cyclohexyl groups.

The aryl group represented by R is preferably a phenyl group, and may have a substituent such as an alkyl, alkoxy or acylamino group.

Examples of the aryl group include phenyl, 4-t-butylphenyl, 2,4-di-t-amylphenyl, 4-tetradecaneamidophenyl, hexadecyl-oxyphenyl and 4'-[α-(4''-t-butylphenoxy)-tetradecaneamido]phenyl groups.

The heterocyclic group represented by R is preferably a 5- to 7-membered heterocyclic ring, and may be substituted or may be condensed. Examples of the heterocyclic group include 2-furyl, 2-thietnyl, 2-pyrimidinyl and 2-benzothiazonyl groups.

The acyl group represented by R includes, for example, an alkylcarbonyl group such as acetyl, phenylacetyl, dodecanoyl and α-2,4-di-t-amylfenoxybutanoyl groups, and an arylcarbonyl group such as benzoyl, 3-pentadecycloxybenzoyl and p-chlorobenzoyl groups.

The sulfonyl group represented by R includes, for example, an alkylsulfonyl group such as methylsulfonyl and dodecylsulfonyl groups, and an arylsulfonyl group such as benzenesulfonyl and p-toluenesulfonyl groups.

The sulfinyl group represented by R includes, for example, an alkylsulfinyl group such as ethylsulfinyl, octylsulfinyl and 3-fenoxybutylsulfinyl groups and an arylsulfinyl group such as phenylsulfinyl and m-pentadecylphenylsulfinyl groups.

The phosphonyl group represented by R includes, for example, an alkylphosphonyl group such as butyloxyoctyl phosphonyl group, an alkoxyphosphonyl group such as octyloxyphosphonyl group, an aryloxyphosphonyl group such as phenoxyphosphonyl group and an arylphosphonyl group such as phenylphosphonyl group.

The carbamoyl group represented by R includes, for example, those substituted with an alkyl or aryl (preferably phenyl) group, such as, N-methylcarbamoyl, N,N-dibutyl-carbamoyl, N-(2-pentadecyloctylethyl)carbamoyl, N-ethyl-N-dodecylcarbamoyl and N-{3-(2,4-di-t-amylphenoxy)propyl}-carbamoyl group.

The sulfamoyl group represented by R includes, for example, those substituted with an alkyl or aryl (preferably phenyl) group, such as N-propylsulfamoyl, N,N-diethylsulfamoyl, N-(2-pentadecyloxyethyl)sulfamoyl, N-ethyl-N-dodecylsulfamoyl and N-phenylsulfamoyl groups.

The spiro-compound residue represented by R includes, for example, spiro[3,3]heptan-1-yl and the like.

The bridged hydrocarbon compound residue represented by R includes, for example, bicyclo[2,2,1]heptane-1-yl, tricyclo[3,3,1,1$^{3,7}$]decane-1-yl and 7,7-dimethyl-bicyclo-[2,2,1]heptane-1-yl.

The alkoxy group represented by R includes, for example, those substituted further with such a substituent(s) as is shown above with the alkyl group, such as methoxy, propoxy, 2-ethoxyethoxy, pentadecyloxy, 2-dodecyloxyethoxy and phenethyloxyethoxy.

The aryloxy group represented by R is preferably a phenyloxy group, an includes, for example, those of which aryl nucleus is further substituted with such a substituent(s) or an atom(s) as is shown above with the aryl group, such as phenoxy, p-t-butylphenoxy and m-pentadecylphenoxy groups.

The heterocyclicoxy group represented by R is preferably one having a 5- to 7-membered heterocyclic ring, and includes those of which heterocyclic ring has a substituent, such as 3,4,5,6-tetrahydropyranyl-2-oxy and 1-phenyltetrazole-5-oxy groups.

The siloxy group represented by R includes those substituted with an alkyl group, for example, trimethylsiloxy, triethylsiloxy and dimethylbutylsiloxy groups.

The acyloxy group represented by R includes, for example, alkylcarbonyloxy and arylcarbonyloxy groups, and further includes those having a substituent(s) such as acetyloxy, α-chloroacetyloxy and benzoyloxy groups.

The carbamoyloxy group represented by R includes those substituted with an alkyl or aryl group, such as N-ethylcarbamoyloxy, N,N-diethylcarbamoyloxy and N-phenylcarbamoyloxy groups.

The amino group represented by R includes those substituted with an alkyl or aryl (preferably phenyl) group, such as ethylamino, anilino, m-chloroanilino, 3-pentadecyloxycarbonylanilino and 2-chloro-5-hexadecaneamidoanilino groups.

The acylamino group represented by R includes alkylcarbonylamino and arylcarbonylamino (preferably phenylcarbonylamino) groups, and further includes those having a substituent(s) such as acetamido, α-ethylpropane-amido, N-phenylacetamido, dodecaneamido, 2,4-di-t-amylphenoxyacetamido and α-3-t-butyl-4-hydroxyphenoxybutane-amido groups.

The sulfonamido group represented by R includes alkylsulfonylamino and arylsulfonylamino groups, and further includes those having a substituent(s), such as methylsulfonylamino, pentadecylsulfonylamino, benzensulfonamido, p-toluenesulfonamido and 2-methoxy-5-t-amylbenzenesulfonamido groups.

The imido group represented by R includes those which are open-chained or close-chained, and further includes those having a substituent(s), such as, succinimido, 3-heptadecylsuccinimido, phthalimido and glutarimido groups.

The ureido group represented by R includes those substituted with an alkyl or aryl (preferably phenyl) group, such as N-ethylureido, N-methyl-N-decylureido, N-phenylureido and N-p-tolylureido groups.

The sulfamoylamino group represented by R includes those substituted with an alkyl or aryl (preferably phenyl) group, such as N,N-dibutylsulfamoylamino, N-methylsulfamoylamino and N-phenylsulfamoylamino groups.

The alkoxycarbonylamino group represented by R includes those having a substituent(s), such as methoxycarbonylamino, methoxyethoxycarbonylamino and octadecyloxycarbonylamino groups.

The aryloxycarbonylamino group represented by R includes those having a substituent(s), such as phenoxycarbonylamino and 4-methylphenoxycarbonylamino groups.

The alkoxycarbonyl group represented by R includes those having a substituent(s), such as methoxycarbonyl, butyloxycarbonyl, dodecyloxycarbonyl, octadecyloxycarbonyl, ethoxymethoxycarbonyloxy and benzyloxycarbonyl groups.

The aryloxycarbonyl group represented by R includes those having a substituent(s), such as phenoxycarbonyl, p-chlorophenoxycarbonyl and m-pentadecyloxyphenoxycarbonyl groups.

The alkylthio group represented by R includes those having a substituent(s), such as ethylthio, dodecylthio, octadodecylthio, phenethylthio and 3-phenoxypropylthio groups.

The arylthio group represented by R is preferably a phenylthio group, and includes those having a substituent(s), such as phenylthio, p-methoxyphenylthio, 2-t-octylphenylthio, 3-octadecylphenylthio, 2-carboxyphenylthio and p-acetaminophenylthio groups.

The heterocyclicthio group, represented by R is preferably a 5- to 7-membered heterocyclicthio group, and includes those having a condensed ring or having a substituent(s). Examples of such heterocyclicthio group include 2-pyridylthio, 2-benzothiazolylthio and 2,4-diphenoxy-1,3,5-triazol-6-thio groups.

The substituent represented by X that is capable of leaving upon reaction with the oxidized product of a color developing agent includes, for example, those substituted through the carbon, oxygen, sulfur or nitrogen atom other than the halogen atom (chlorine, bromine or fluorine atom).

The groups which are substituted through the carbon atom include, in addition to the carboxyl group, a group represented by the following formula:

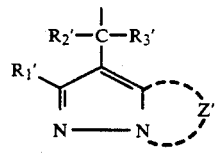

(wherein $R_1'$ is the same in meaning as said R; Z' is the same in meaning as said Z; and $R_2'$ and $R_3'$ each represents a hydrogen atom, an aryl, alkyl or heterocyclic group), a hydroxymethyl group and a triphenylmethyl group.

The groups which are substituted through the oxygen atom include, for example, alkoxy, aryloxy, heterocyclicoxy, acyloxy, sulfonyloxy, alkoxycarbonyloxy, aryloxycarbonyl, alkyloxalyloxy and alkoxyoxalyloxy groups.

The alkoxy group includes those having a substituent(s), such as ethoxy, 2-phenoxyethoxy, 2-cyanoethoxy, phenethyloxy, and p-chlorobenzyloxy groups.

The aryloxy group is preferably a phenoxy group, and includes those having a substituent(s). Examples of such aryloxy group include phenoxy, 3-methylphenoxy, 3-dodecylphenoxy, 4-methanesulfoneamidophenoxy, 4-[α-(3'-pentadecylphenoxy)butaneamido]phenoxy, hexadecylcarbamoylmethoxy, 4-cyanophenoxy, 4-methanesulfonylphenoxy, 1-naphthyloxy and p-methoxyphenoxy groups.

The heterocyclicoxy group is preferably a 5- to 7-membered heterocyclicoxy group, and may be a condensed ring or include those having a substituent(s). Examples of such heterocyclicoxy group include 1-phenyltetrazolyloxy and 2-benzothiazolyloxy groups.

The acyloxy group includes, for example, an alkylcarbonyloxy group such as acetoxy and butanoyloxy groups, an alkenylcarbonyloxy group such as a cinnamoyloxy group, and an arylcarbonyloxy group such as a benzoyloxy group.

The sulfonyloxy group includes, for example, butanesulfonyloxy and methanesulfonyloxy groups.

The alkoxycarbonyloxy group includes, for example, ethoxycarbonyloxy and benzyloxycarbonyloxy groups.

The aryloxycarbonyloxy group includes a phenoxycarbonyloxy group and the like.

The alkyloxalyloxy group includes, for example, a methyloxalyloxy group.

The alkoxyoxalyloxy group includes an ethoxyoxalyloxy group and the like.

The group which is substituted through the sulfur atom includes, for example, alkylthio, arylthio, heterocyclicthio and alkyloxythiocarbonylthio groups.

The alkylthio group includes butylthio, 2-cyanoethylthio, phenetylthio and benzylthio groups.

The arylthio group includes phenylthio, 4-methanesulfoneamidophenylthio, 4-dodecylphenetylthio, 4-nonafluoropentaneamidophenetylthio, 4-carboxyphenylthio and 2-ethoxy-5-t-butylphenylthio groups.

The heterocyclicthio group includes, for example, 1-phenyl-1,2,3,4-tetrazolyl-5-thio and 2-benzothiazolylthio groups.

The alkyloxythiocarbonylthio group includes a dodecyloxythiocarbonylthio group and the like.

The group which is substituted through the nitrogen atom includes, for example, one represented by the formula

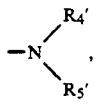

wherein $R_4'$ and $R_5'$ each represents a hydrogen atom, an alkyl, aryl, heterocyclic, sulfamoyl, carbamoyl, acyl, sulfonyl, aryloxycarbonyl or alkoxycarbonyl group, and $R_4'$ and $R_5'$ may cooperate to form a heterocyclic ring, provided that $R_4'$ and $R_5'$ are not hydrogen atoms at the same time.

The alkyl group may be straight-chaned or branched and is preferably one having 1 to 22 carbon atoms. Also, the alkyl group may include those having a substituent(s). Examples of such substituent include, for example, aryl, alkoxy, aryloxy, alkylthio, arylthio, alkylamino, arylamino, acylamino, sulfoneamido, imino, acyl, alkylsulfonyl, arylsulfonyl, carbamoyl, sulfamoyl, alkoxycarbonyl, aryloxycarbonyl, alkyloxycarbonylamino, aryloxycarbonylamino, hydroxy, carboxyl and ciano groups and halogen atom. Examples of such alkyl group includes, for example, ethyl, octyl, 2-ethylhexyl and 2-chloroethyl group.

The aryl group represented by $R_4'$ or $R_5'$ is preferably one having 6 to 32 carbon atoms, particularly a phenyl or naphtyl group, and may include those having a substituent(s). Such substituent includes a substituent for the alkyl group represented by $R_4'$ or $R_5'$ and an alkyl group. Examples of the aryl group include, for example, phenyl, 1-naphtyl and 4-methylsulfonylphenyl groups.

The heterocyclic group represented by $R_4'$ or $R_5'$ is preferably a 5- or 6-membered ring, and may be a condensed ring or include those having a substituent(s). Examples of such heterocyclic group include 2-furyl, 2-quinolyl, 2-pyrimidyl, 2-benzothiazolyl and 2-pyridyl groups.

The sulfamoyl group represented by $R^{4'}$ or $R_5'$ includes N-alkylsulfamoyl, N,N-dialkylsulfamoyl, N-arylsulfamoyl and N,N-diarylsulfamoyl groups, and these alkyl and aryl groups may have such a substituent(s) as is mentioned with respect to the alkyl and aryl groups. Examples of such sulfamoyl group includes, for example, N,N-diethylsulfamoyl, N-methylsulfamoyl, N-dodecylsulfamoyl and N-p-tolylsulfamoyl groups.

The carbamoyl group represented by $R_4'$ or $R_5'$ includes N-alkylcarbamoyl, N,N-dialkylcarbamoyl, N-arylcarbamoyl and N,N-diarylcarbamoyl groups, and these alkyl and aryl groups may have such a substituent(s) as is mentioned with respect to the alkyl and aryl groups. Examples of such carbamoyl group include, for example, N,N-diethylcarbamoyl, N-methylcarbamoyl, N-dodecylcarbamoyl, N-p-cianophenylcarbamoyl and N-p-tolylcarbamoyl groups.

The acyl group represented by $R_4'$ or $R_5'$ includes for example, alkylcarbonyl, arylcarbonyl and heterocyclic carbonyl groups, and the alkyl, aryl and heterocyclic groups may have a substituent(s). Examples of such acyl group include, for example, hexafluorobutanoyl, 2,3,4,5,6-pentafluorobenzoyl, acetyl, benzoyl, naphtoyl and 2-furylcarbonyl groups.

The sulfonyl group represented by $R_4'$ or $R_5'$ includes alkylsulfonyl, arylsulfonyl and heterocyclicsulfonyl groups, and may have a substituent(s). Examples of such sulfonyl group include, for example, ethanesulfonyl, benzenesulfonyl, octanesulfonyl, naphthalenesulfonyl and p-chlorobenzenesulfonyl groups.

The aryloxycarbonyl group represented by $R_4'$ or $R_5'$ may have such a substituent(s) as is mentioned with respect to the aryl group, and includes a phenoxycarbonyl group and the like.

The alkoxycarbonyl group represented by $R_4'$ or $R_5'$ may have such a substituent(s) as is mentioned with respect to alkyl group, and includes methoxycarbonyl, dodecyloxycarbonyl and benzyloxycarbonyl groups.

The heterocyclic ring which is formed through cooperation of $R_4'$ and $R_5'$ is preferably a 5- or 6-membered ring, may be saturated or unsaturated, may or may not be an aromatic ring, or may be a condensed ring. Examples of such heterocyclic ring include, for example, N-phthalimido, N-succinimide, 4-N-urazolyl, 1-N-hydantoinyl, 3-N-2,4-dioxooxazolidinyl, 2-N-1,1-dioxo-3-(2H)-oxo-1,2-benzthiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-iso-indolyl, 2-isoindolinyl, 1-benzotriazolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, phthalazione and 2-oxo-1-piperidinyl groups. These heterocyclic groups may be substituted by alkyl, aryl, alkyloxy, aryloxy, acyl, sulfonyl, alkylamino, arylamino, acylamino, sulfoneamino, carbamoyl, sulfamoyl, alkylthio, arylthio, ureido, alkoxycarbonyl, aryloxycarbonyl, imido, nitro, cyano, carboxyl groups as well as by a halogen atom and the like.

The nitrogen-containing heterocyclic ring which is formed by Z or Z' includes pyrazol, imidazol, triazol and tetrazol rings, and may have such a substituent(s) as is mentioned with respect to R.

When the substituent(s) (for example, either of R and $R_1$ to $R_8$) on the heterocyclic ring in formula (I) and in formulas (II) to (VIII) to be mentioned later has the following formula:

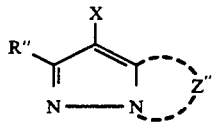

(wherein R'', X and Z'' are the same in meaning as R, X and Z in formula (I), respectively), the coupler formed is the so-called bis-type coupler, which is included in the present invention. The ring which is formed by Z, Z', Z'' as well by $Z_1$ to be stated later may be condensed with another ring (for example 5- to 7-membered cycloalkene). For example, in formula (V), $R_5$ and $R_6$, and in formula (VI), $R_7$ and $R_8$, may cooperate to form a ring (for example, 5- to 7-membered cycloalkene, or benzene), respectively.

The coupler represented by formula (I) preferably includes, for example, those represented by the following formulas (II) to (VII):

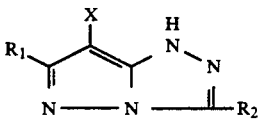

(II)

-continued

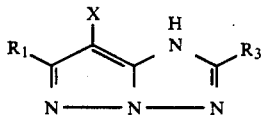

(III)

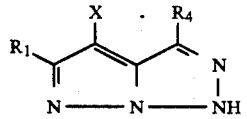

(IV)

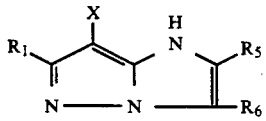

(V)

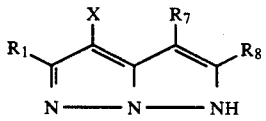

(VI)

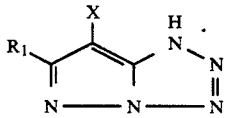

(VII)

wherein $R_1$ to $R_8$ and X are the same in meaning as R and X mentioned above.

The coupler of formula (I) is preferably one represented by the following formula (VIII):

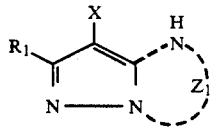

(VIII)

wherein $R_1$, X and $Z_1$ are the same in meaning as R, X and Z in formula (I).

Of the magenta couplers represented by formulas (II) to (VII), those represented by formulas (II) and (III) preferable and those represented by formula (II) are particularly preferable.

With respect to the substituent(s) on the heterocyclic ring in formulas (I) to (VIII), R in formula (I) and $R_1$ in formulas (II) to (VIII) are preferable when they satisfy the following requirement 1, the same R and $R_1$ are more preferable when they satisfy the following requirements 1 and 2, and the same R and $R_1$ are most preferable when they satisfy all of the following requirements 1, 2 and 3:

Requirement 1: The root atom bonded directly to the heterocyclic ring is a carbon atom.

Requirement 2: Said carbon atom has only one hydrogen atom or has no hydrogen atom at all, bonded thereto.

Requirement 3: The bonds between said carbon atom and adjacent atoms are all single bonds.

The most preferable substituents R and $R_1$ on the heterocyclic ring are those represented by the following formula (IX):

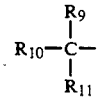

(IX)

wherein $R_9$, $R_{10}$ and $R_{11}$ each represents a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, carbamoyl group, a sulfamoyl group, a cyano group, a spiro-compound residue, a bridged hydrocarbon compound residue, an alkoxy group, an aryloxy group, a heterocyclicoxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group, provided that at least two of $R_9$, $R_{10}$ and $R_{11}$ are not hydrogen atoms.

Two of $R_9$, $R_{10}$ and $R_{11}$, for example, $R_9$ and $R_{10}$ may cooperate to form a saturated or unsaturated ring (e.g., cycloalkane, cycloalkene or heterocyclic ring), and further $R_{11}$ may cooperate with said ring to form a bridged hydrocarbon compound residue.

The group represented by $R_9$ to $R_{11}$ may have a substituent(s). Examples of said group and said substituent(s) are the same as the examples of the group represented by R in formula (I) and the substituent(s) mentioned with respect thereto.

Examples of the ring formed by the cooperation of, for example, $R_9$ and $R_{10}$, as well as of the bridged hydrocarbon compound residue which is formed by $R_9$ to $R_{11}$ and the substituent(s) which said residue may have, are the same as the examples of the cycloalkyl, cycloalkenyl, and heterocyclic groups represented by R in formula (I), and the substituent(s) mentioned with respect thereto.

The preferable substituents in formula (IX) are as follows:

(i) Two of $R_9$ to $R_{11}$ are alkyl groups.

(ii) One of $R_9$ to $R_{11}$, for example, $R_{11}$ is a hydrogen atom, and the other two, $R_9$ and $R_{10}$, cooperate with the root carbon atom to form a cycloalkyl group.

Further, the preferable substituent(s) in (i) above is such that two of $R_9$ to $R_{11}$ are alkyl group, and the other one is a hydrogen atom or an alkyl group.

The alkyl and cycloalkyl groups each may have a substituent(s). Examples of such alkyl and cycloalkyl groups as well as of their substituents are the same as the examples of the alkyl and cycloalkyl groups represented by R in formula (I) and the substituents mentioned with respect thereto.

1
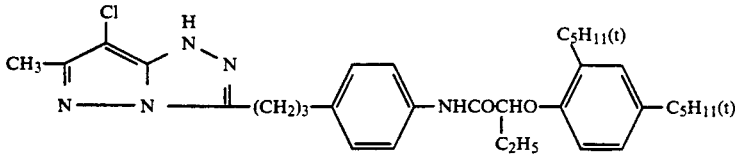
2
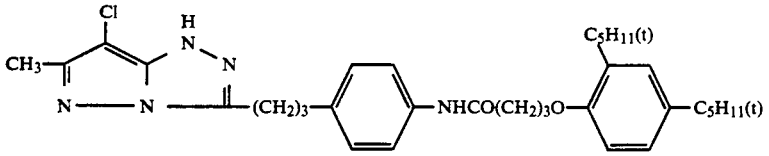
3
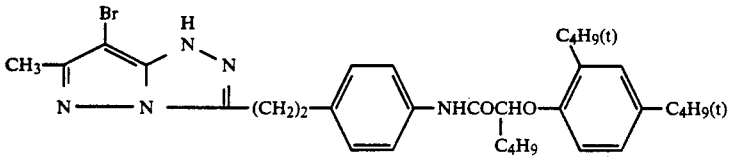
4
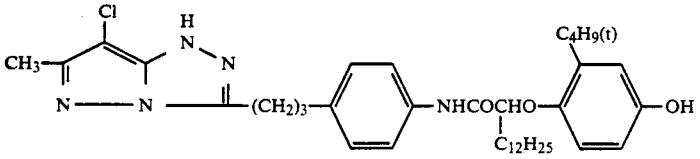
5
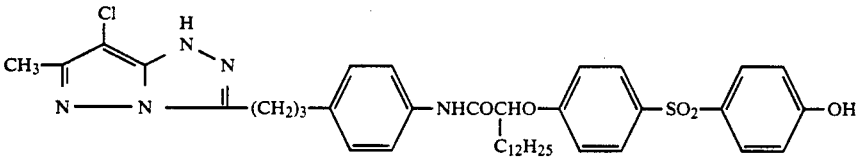
6
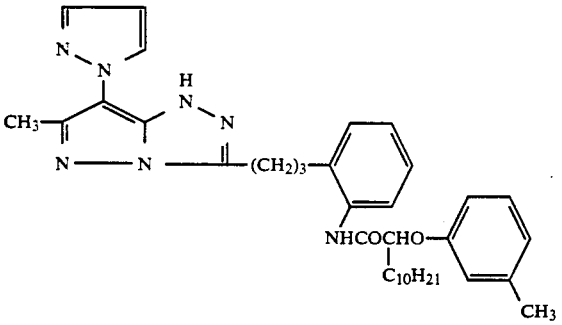
7
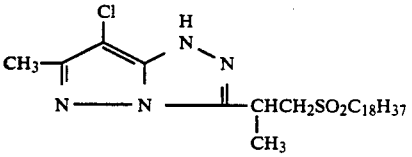
8
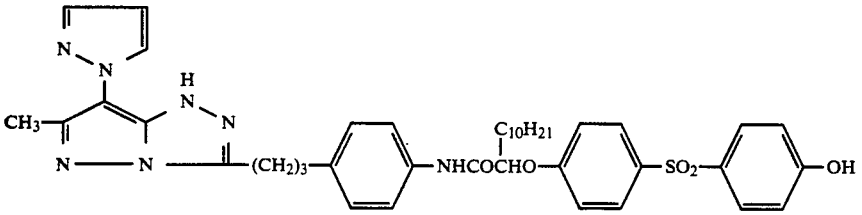

-continued
9
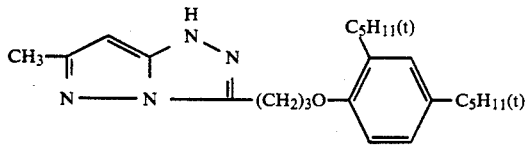
10
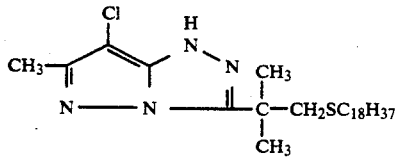
11
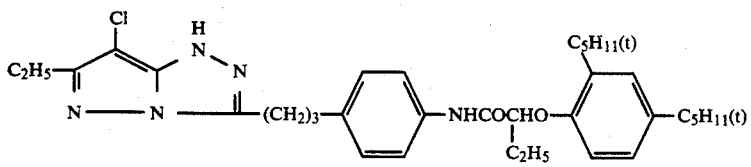
12
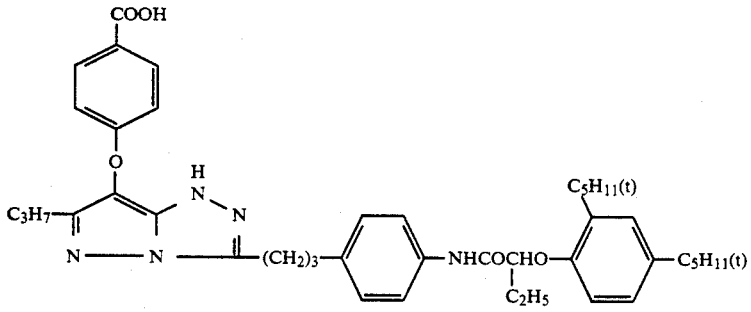
13
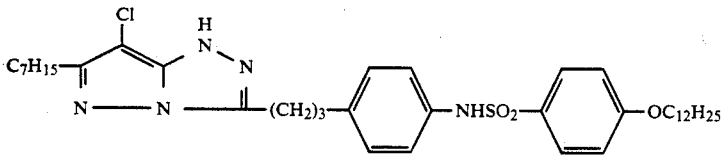
14
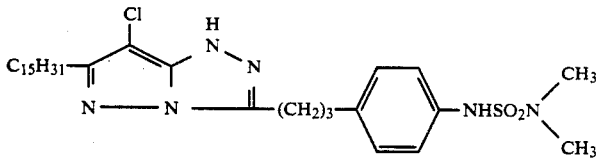
15
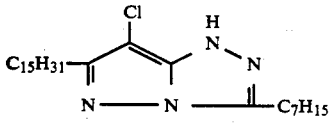
16
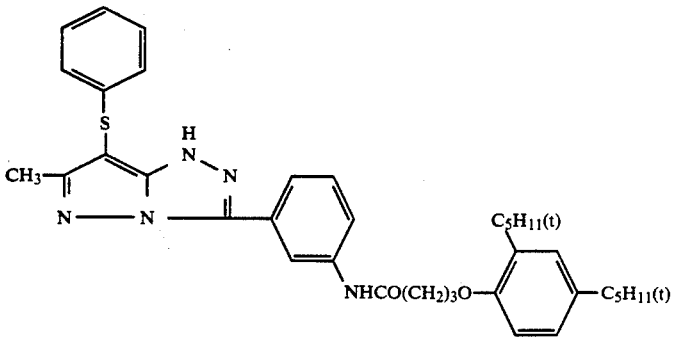

-continued
17
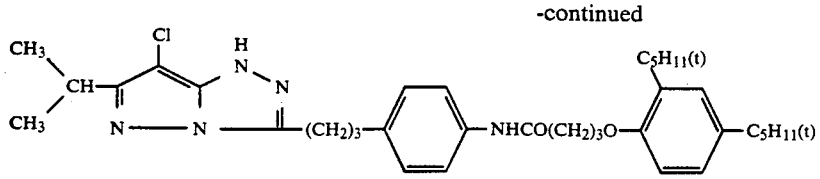
18
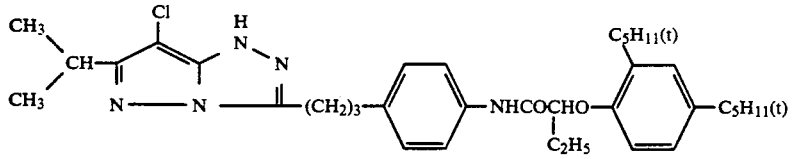
19
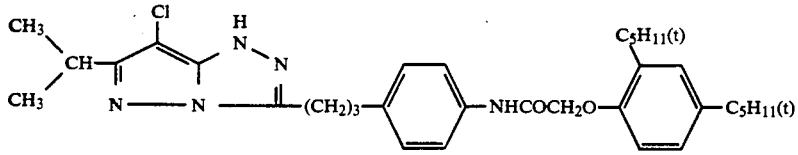
20
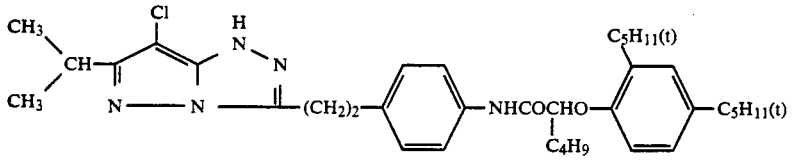
21
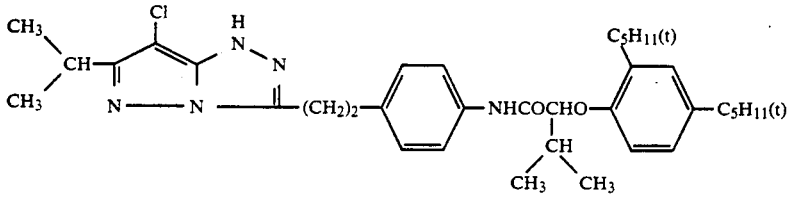
22
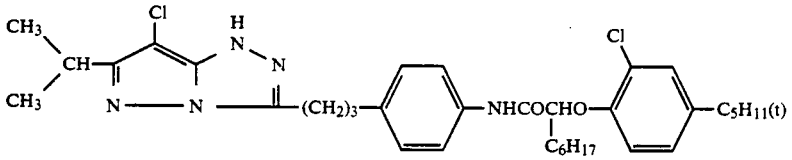
23
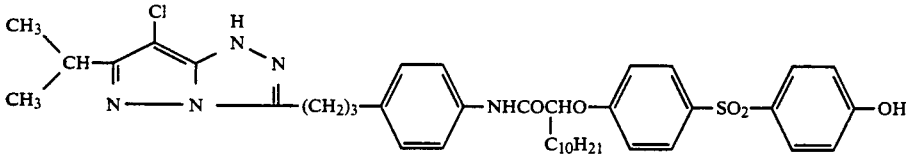
24
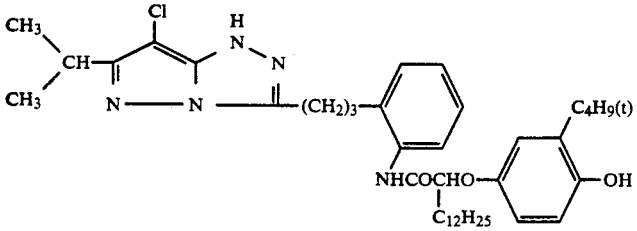
25
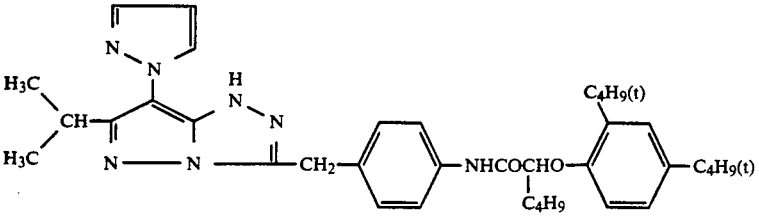

-continued
26
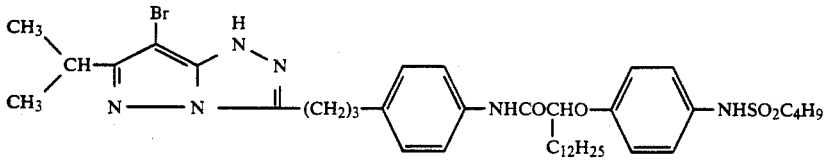
27
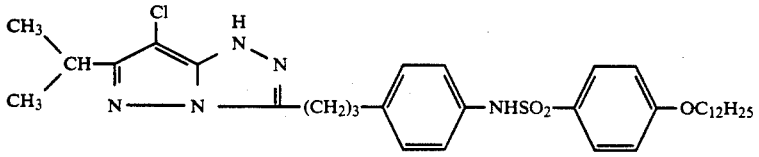
28
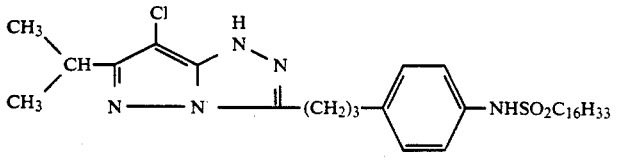
29
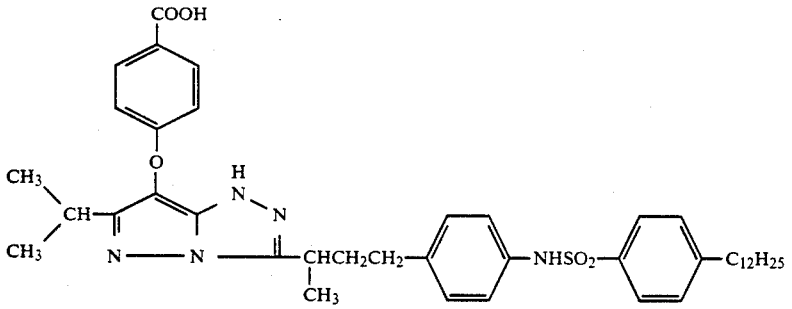
30
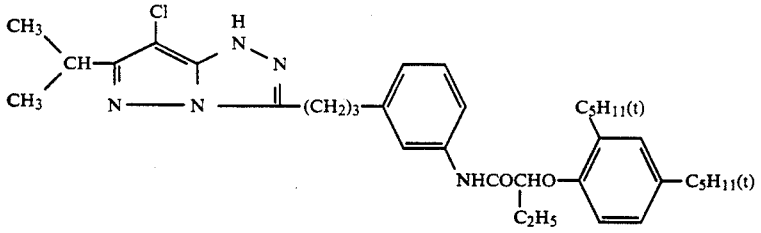
31
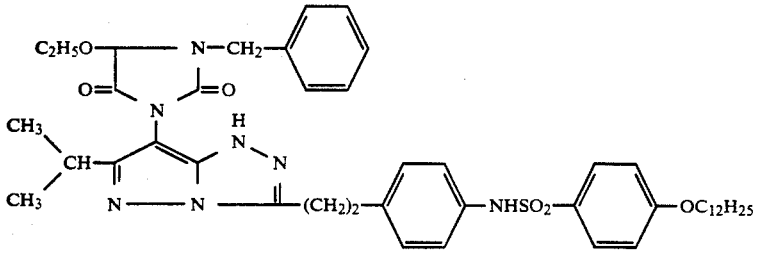

-continued
32
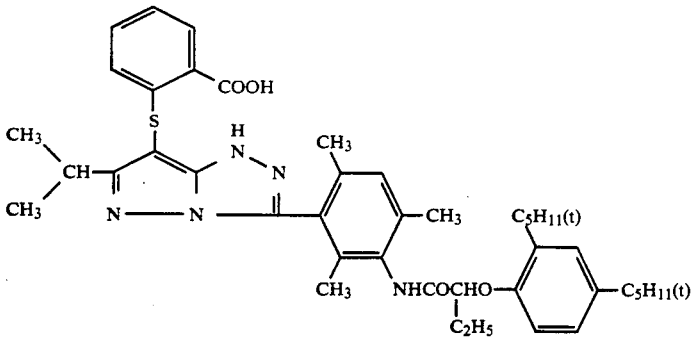
33
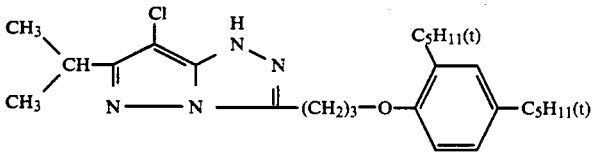
34
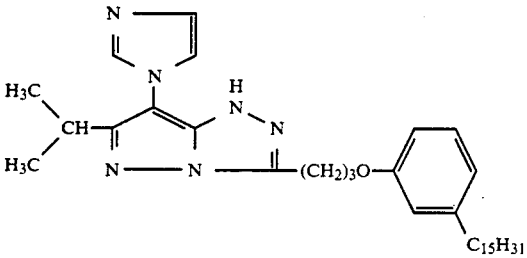
35
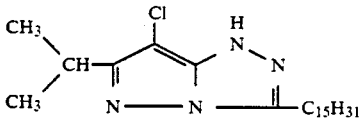
36
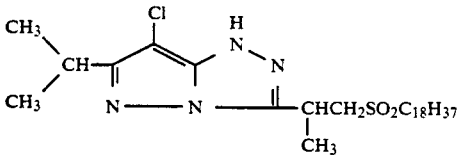
37
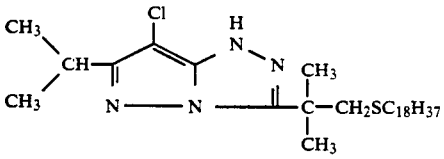
38
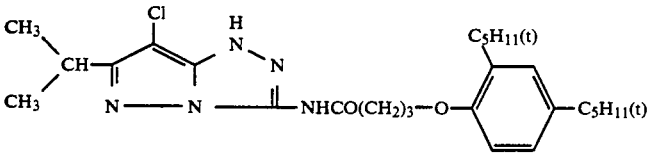
39
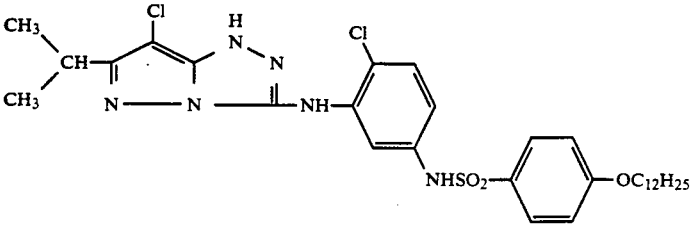

-continued
40
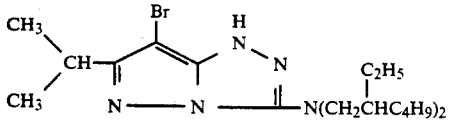
41
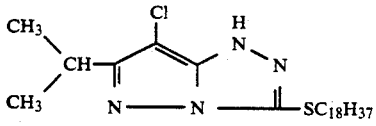
42
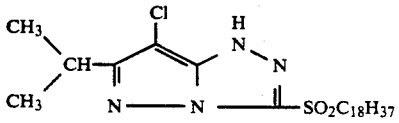
43
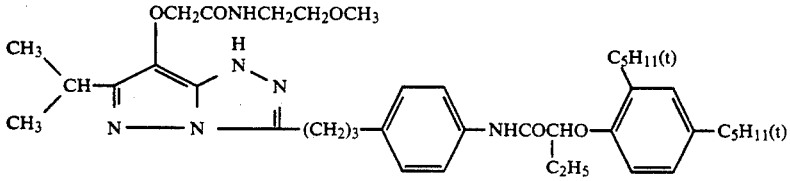
44
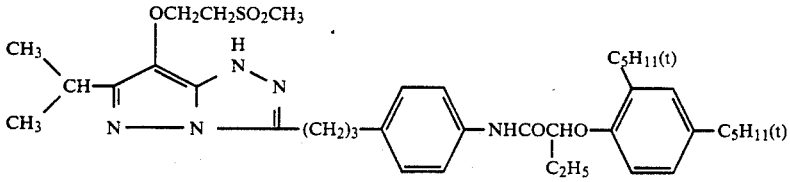
45
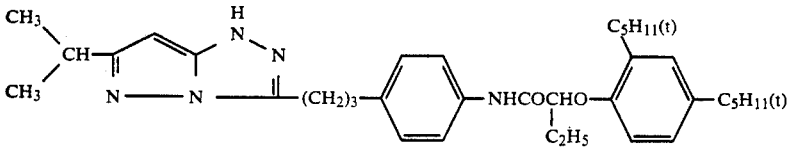
46
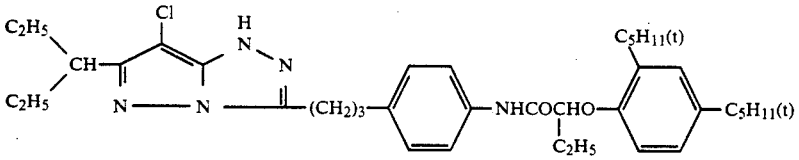
47
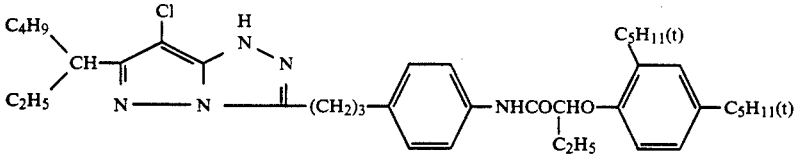
48
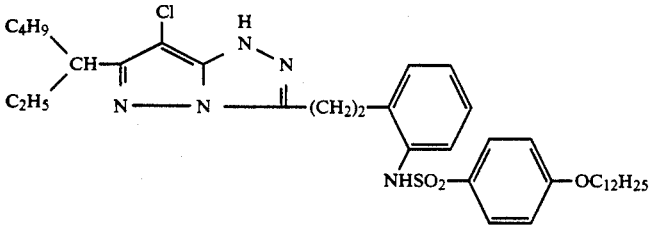
49
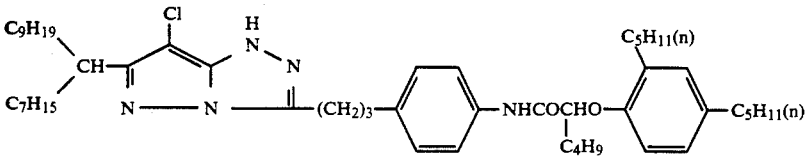

-continued
50
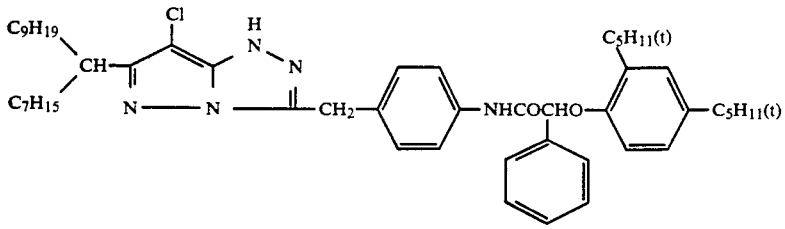
51
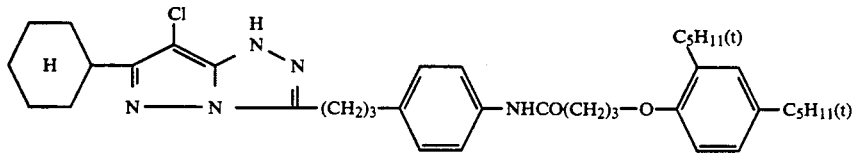
52
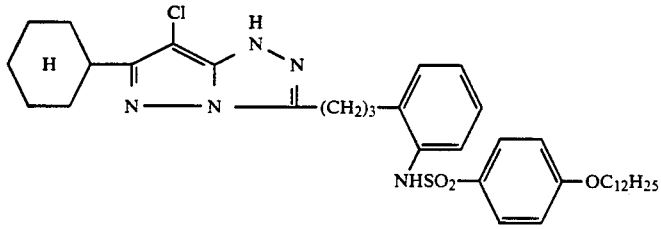
53
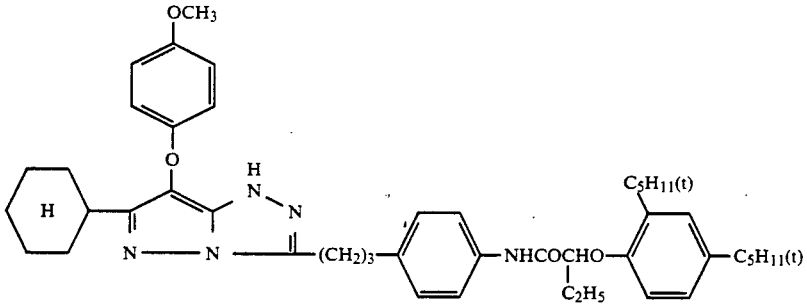
54
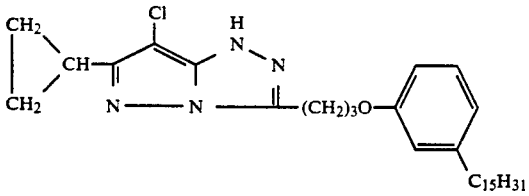
55
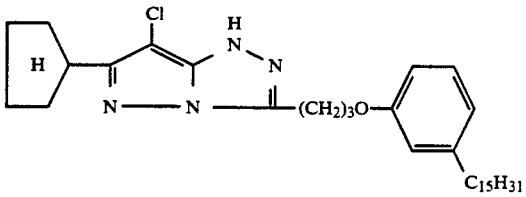
56
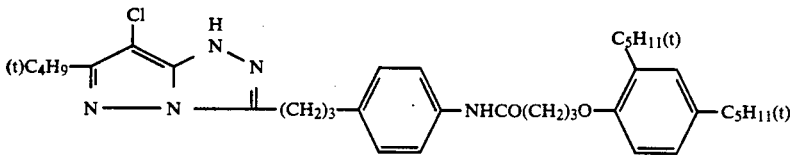

-continued
57
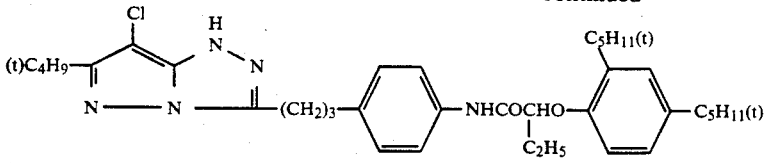
58
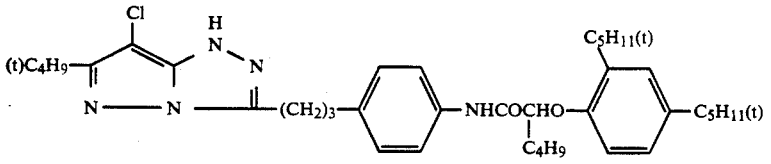
59
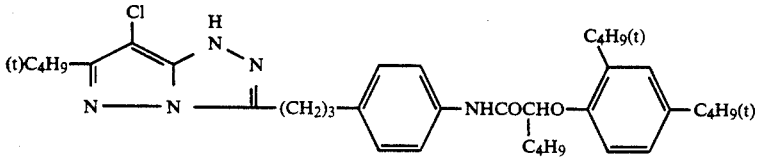
60
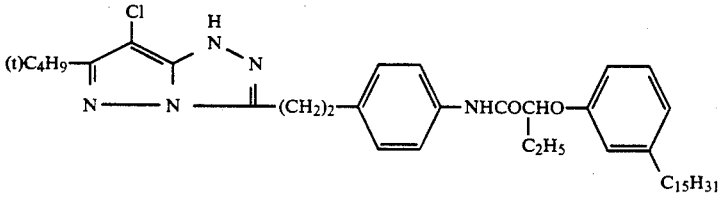
61
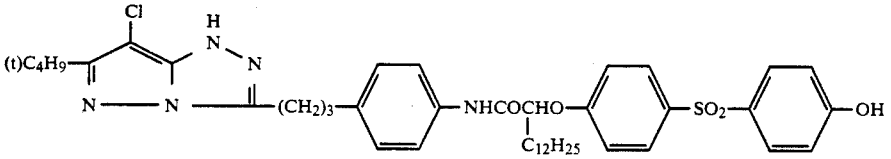
62
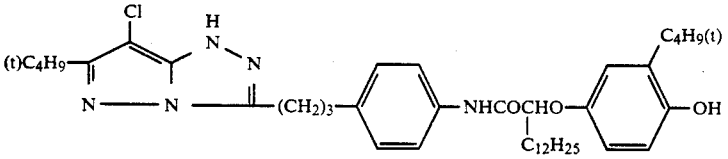
63
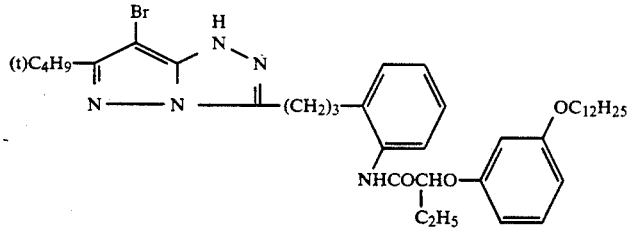
64
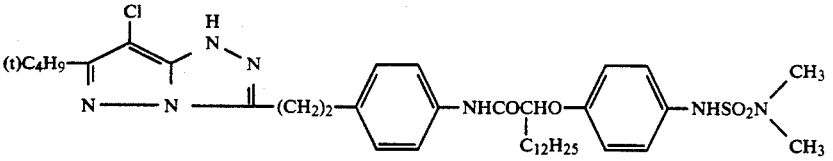
65
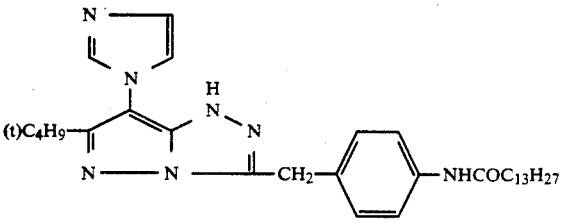

-continued
66
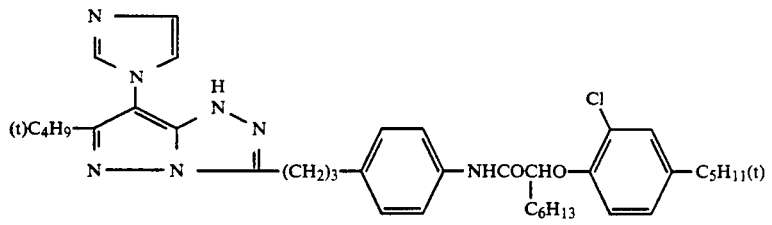
67
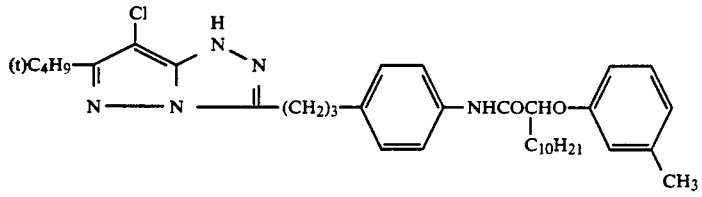
68
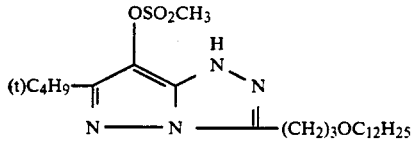
69
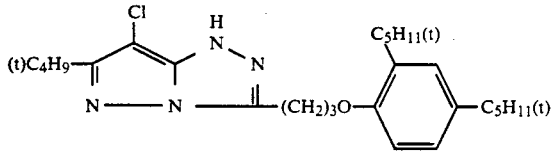
70
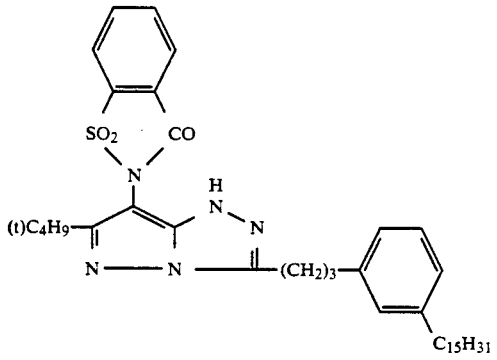
71
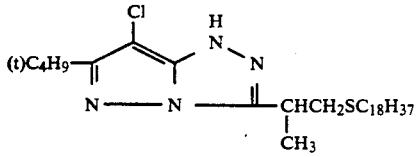
72
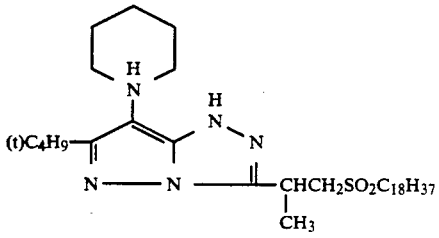

-continued
73
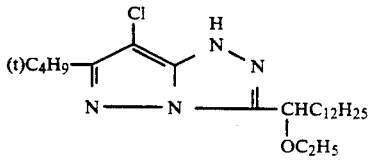
74
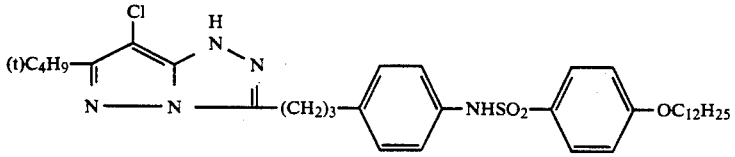
75
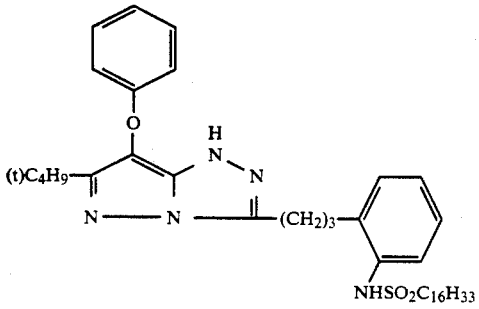
76
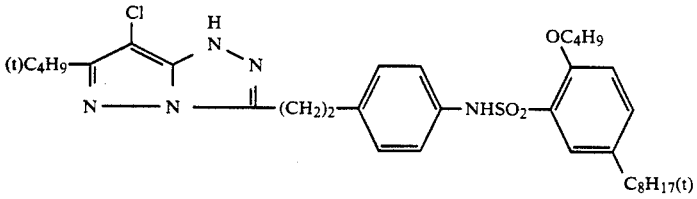
77
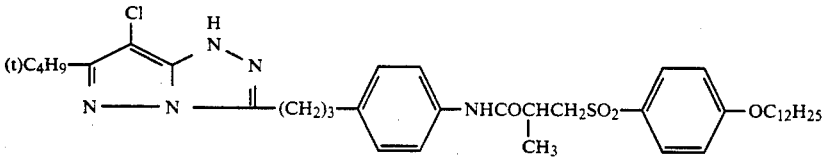
78
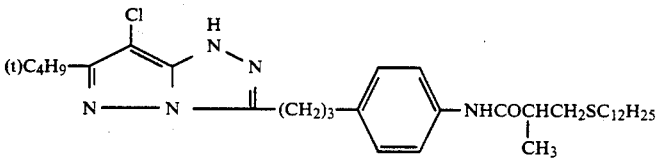
79
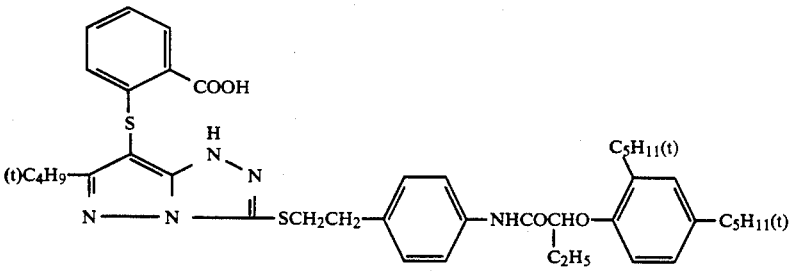
80
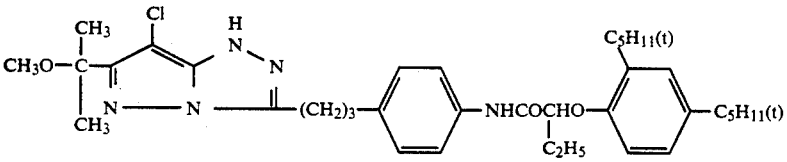

-continued
81
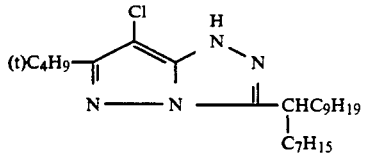
82
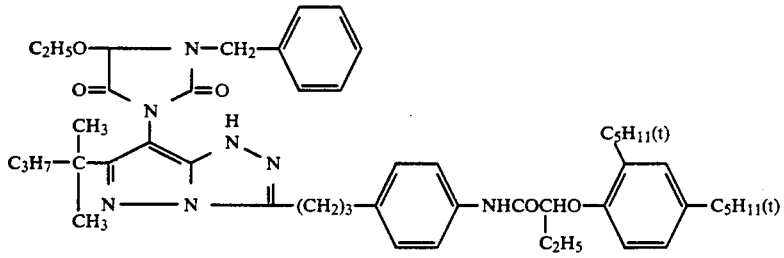
83
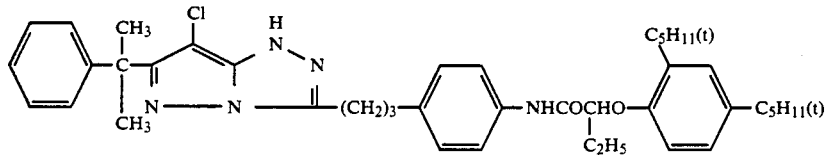
84
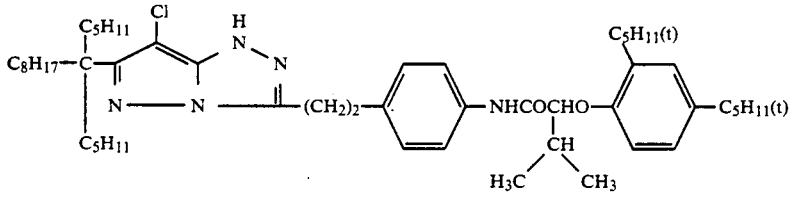
85
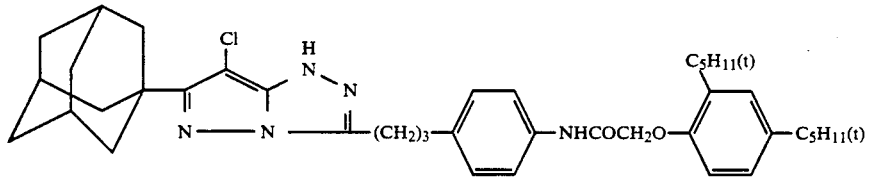
86
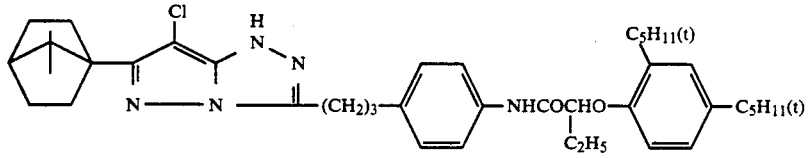
87
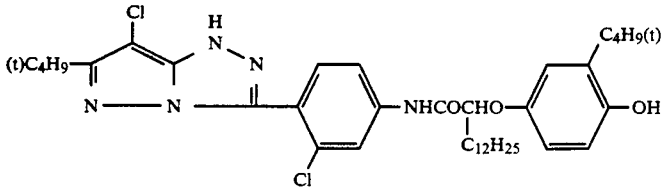

-continued
88
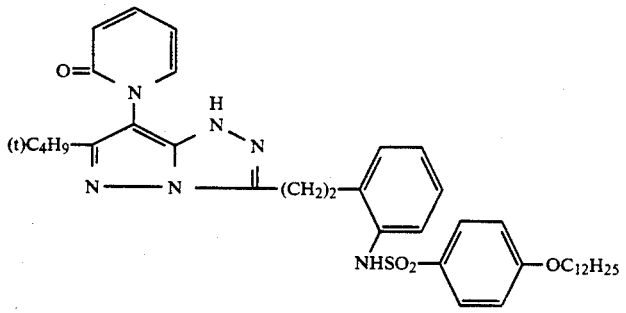
89
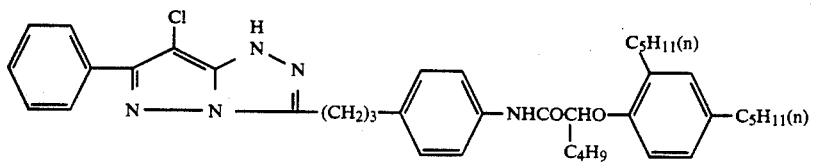
90
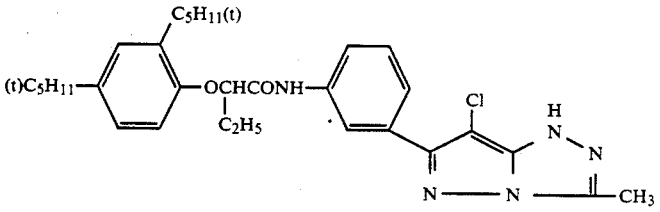
91
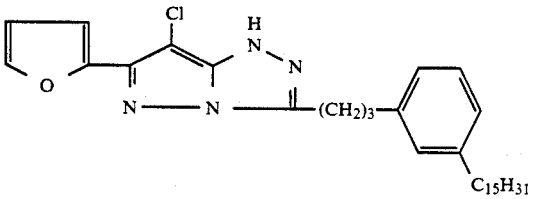
92
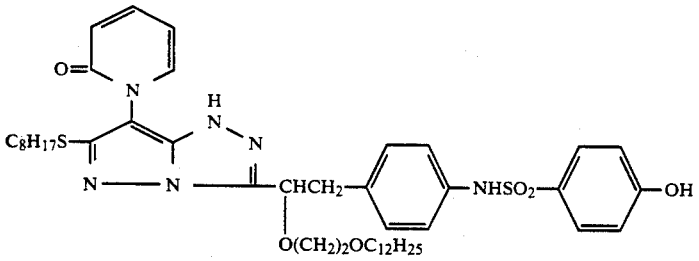
93
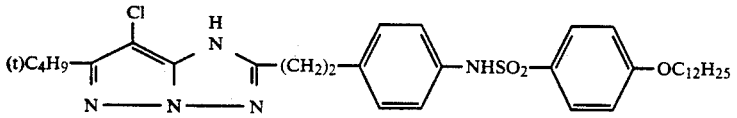
94
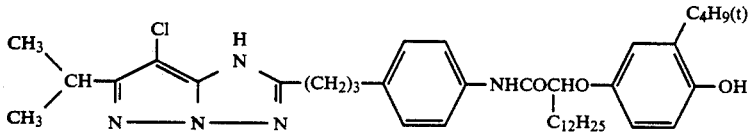
95
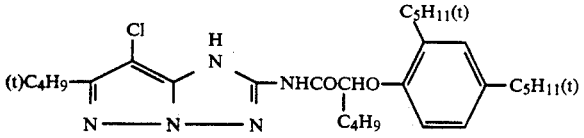

-continued
96
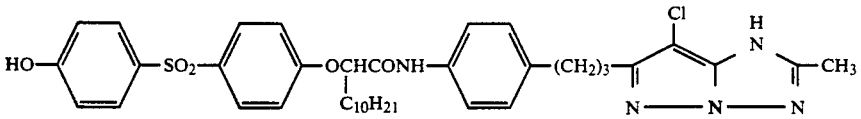
97
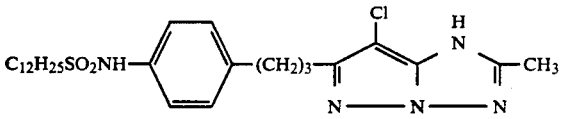
98
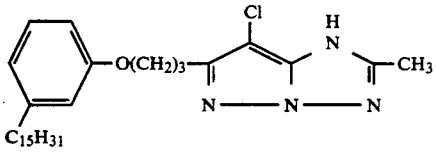
99
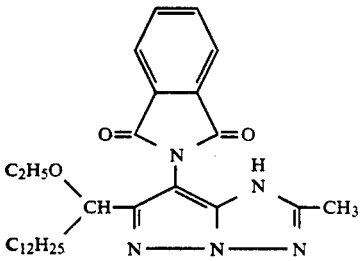
100
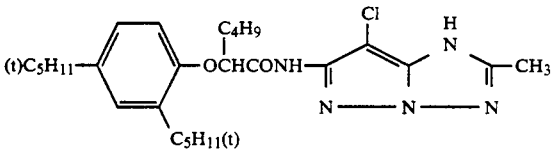
101
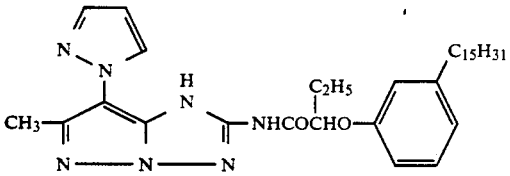
102
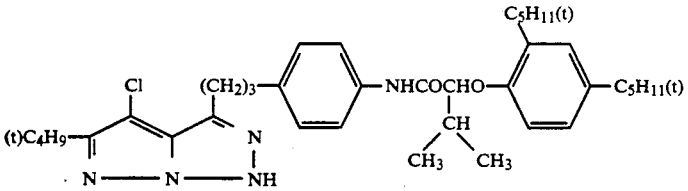
103
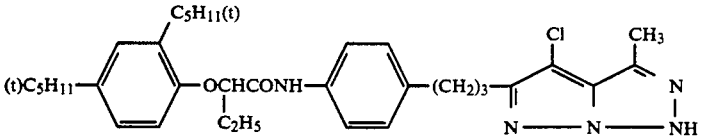
104
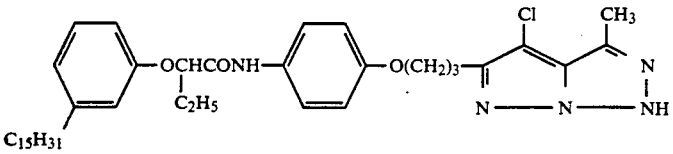

-continued
105
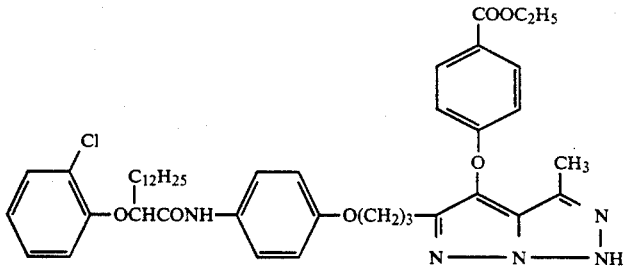
106
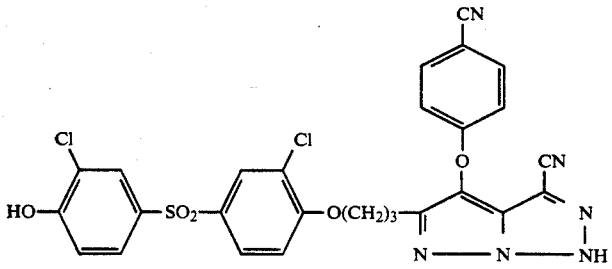
107
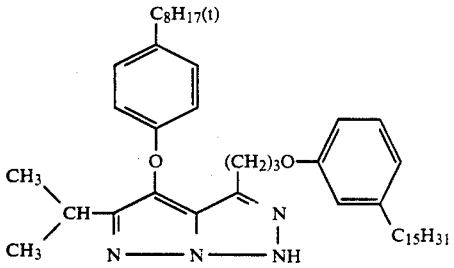
108
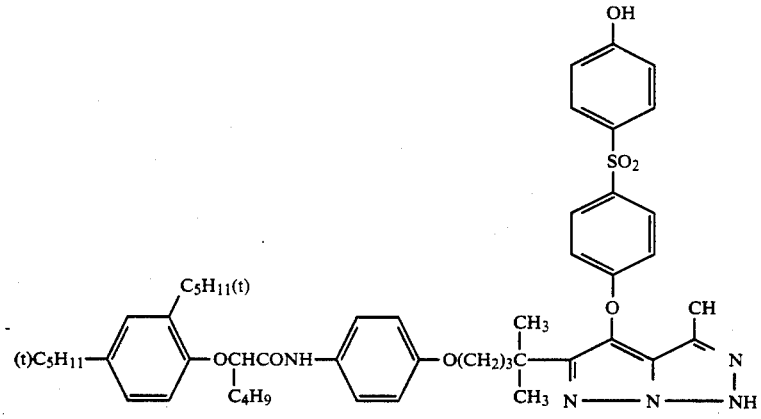
109
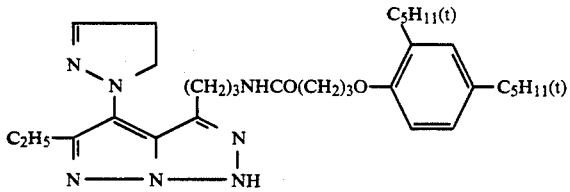
110
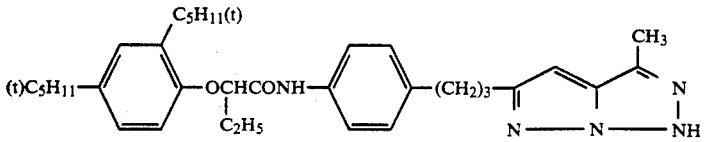

-continued
111
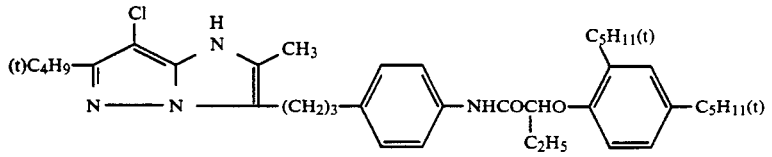
112
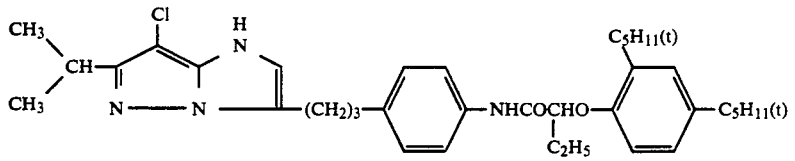
113
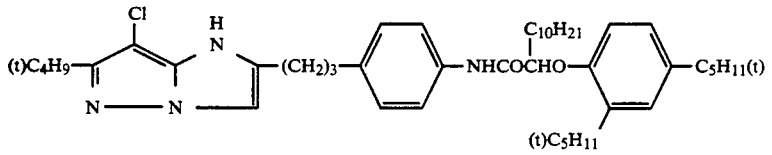
114
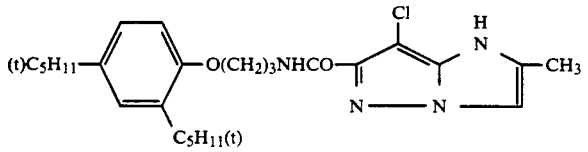
115
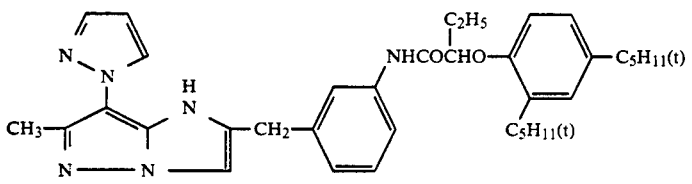
116
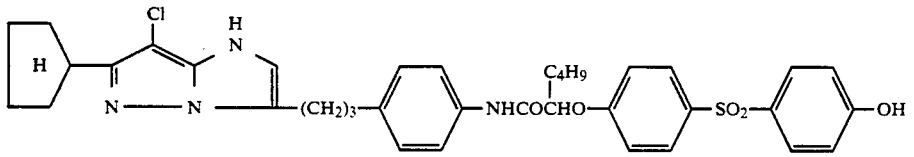
117
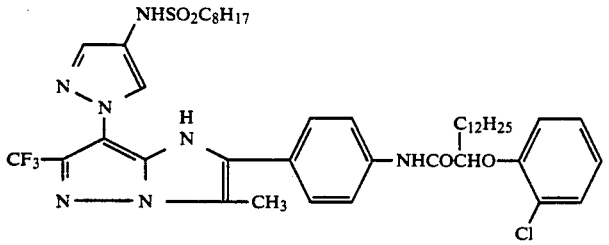
118
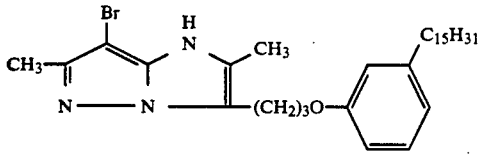
119
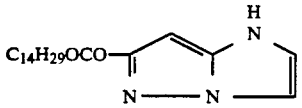

-continued
120
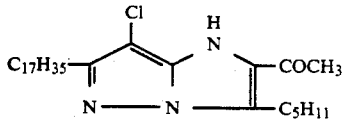
121
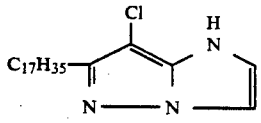
122
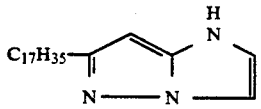
123
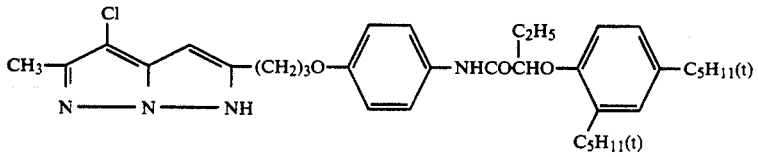
124
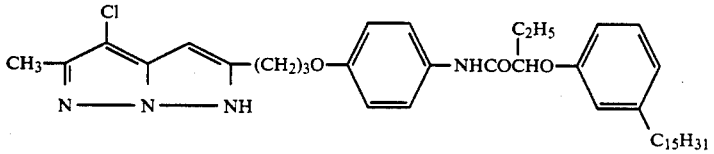
125
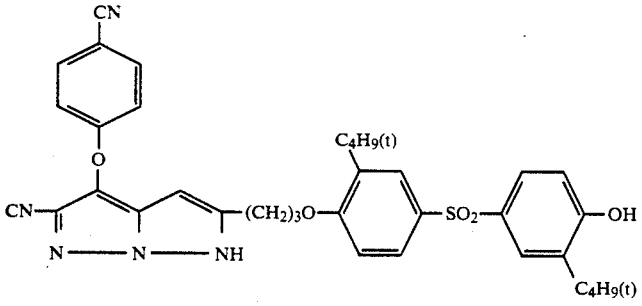
126
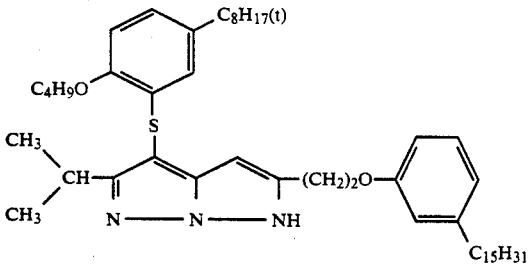
127
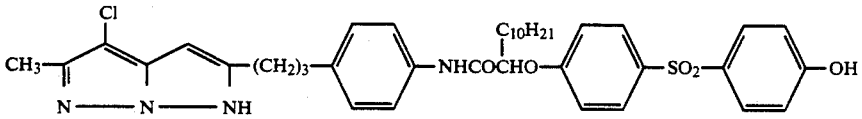
128
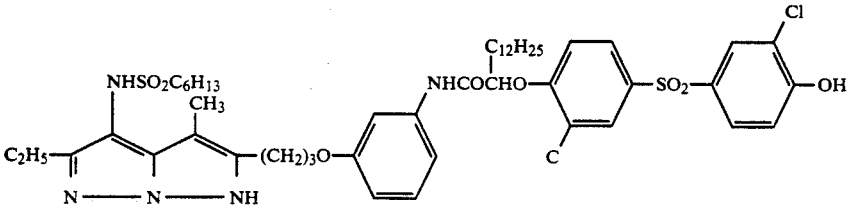

-continued
129
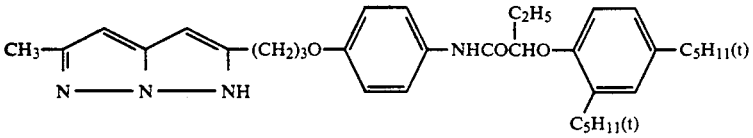
130
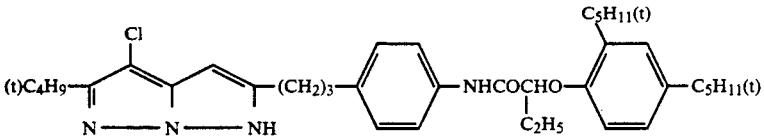
131
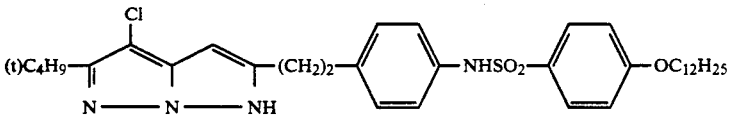
132
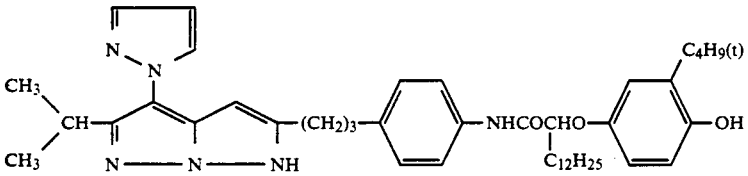
133
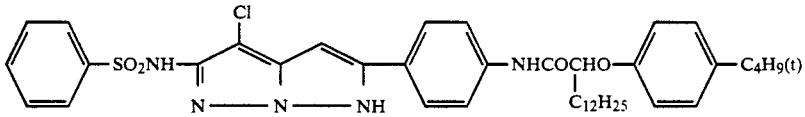
134
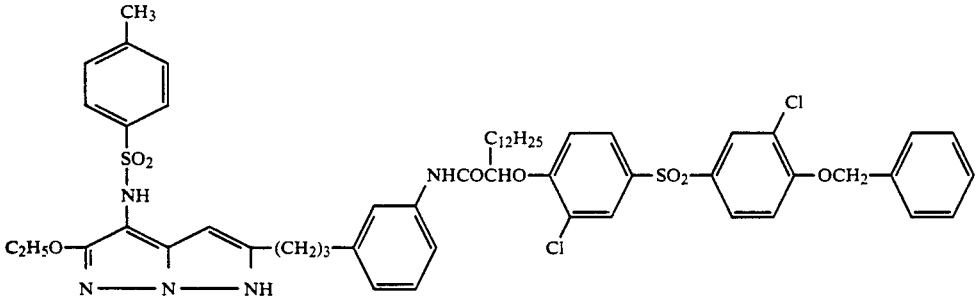
135
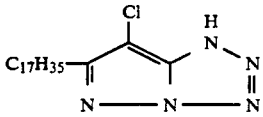
136
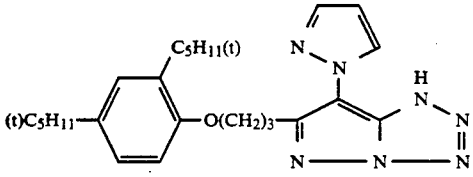
137
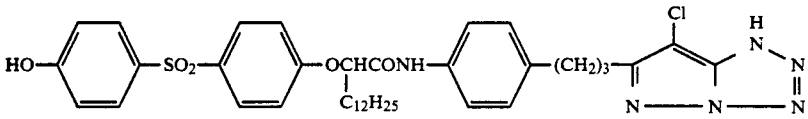

-continued

138

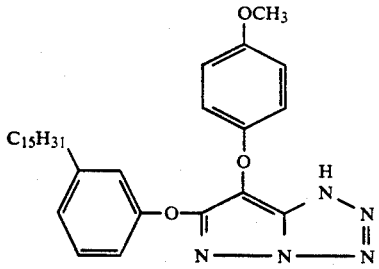

139

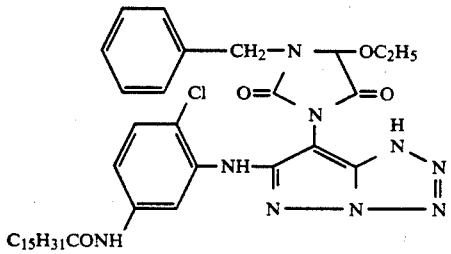

140

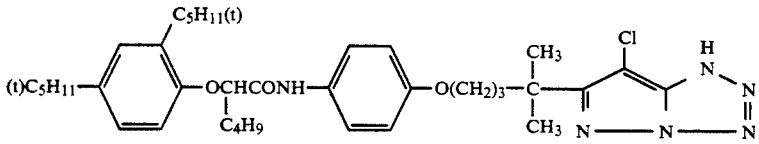

141

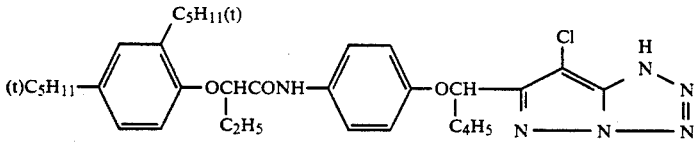

142

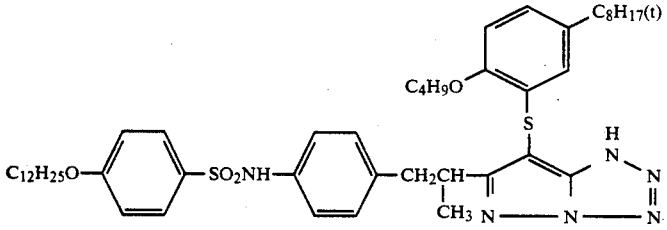

143

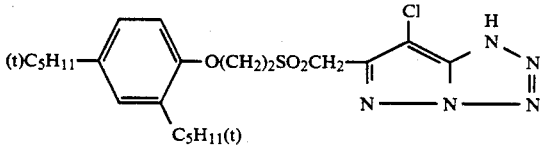

These couplers were synthesized by reference to Journal of the Chemical Society, Perkin I (1977), pages 047 to 2052, U.S. Pat. No. 3,725,067 and Unexamined Published Japanese Patent Application Nos. 99437/1984, 2045/1983, 162548/1984, 59171956/1984, 33552/1985 and 3659/1985.

The coupler of the present invention is usually incorporated in an amount within the range of $1\times10^{-3}$ mole to 1 mole, preferably $1\times10^{-2}$ mole to $8\times10^{-1}$ mole, per mole of silver halide.

The coupler of the present invention may be used in combination with any other type of magenta coupler.

The silver halide photographic material of the present invention may be used as a multi-color photographic material, and in this case, yellow and cyan couplers customarily used in the art may be incorporated by conventional techniques in addition to the magenta coupler defined hereinbefore. If necessary, a colored coupler capable of color correction, or a DIR coupler that releases a development accelerator as development proceeds may be used. Two or more of these couplers may be incorporated in the same layer, or the same compound may be incorporated in two or more different layers so long as the photographic material is provided with the desired characteristics.

Known open-chain ketomethylene compounds may be used as yellow couplers in the present invention, and advantageous examples are benzoyl type, acetanilide type and pivaloyl acetanilide type couplers. Specific examples of these couplers are described in U.S. Pat. Nos. 2,875,057, 3,265,506, 3,277,155, 3,408,194, 3,415,652, 3,447,928 and 3,664,841, as well as Japanese Patent Publication No. 13574/1974, and Unexamined Published Japanese Patent Application Nos. 29432/1973, 66834/1973, 10736/1974, 122335/1974, 28834/1975 and 132926/1975.

Phenolic and naphtholic derivatives are generally used as cyan couplers in the present invention. Specific examples of the cyan couplers are found in U.S. Pat. Nos. 2,423,730, 2,474,293, 2,801,171, 2,895,826, 3,476,563, 3,737,316, 3,758,308 and 3,839,044, as well as Unexamined Published Japanese Patent Application Nos. 37425/1972, 10135/1975, 25228/1975, 112038/1975, 117422/1975, 130441/1975, 109630/1978, 163537/1980,29235/1981, 55945/1981, 65134/1981, 80045/1981, 99341/1981, 116030/1981, 104333/1981, 31953/1984 and 124341/1984.

Antioxidants are preferably incorporated in the layer containing the magenta coupler of the present invention. Compounds useful as antioxidants are described in U.S. Pat. Nos. 3,935,016, 3,982,944, 4,254,216, 3,700,455, 3,764,337, 3,432,300, 3,574,627 and 3,573,050; British Patent No. 1,347,556; British Patent Application Nos. 2,066,975, 2,077,455 and 2,062,888; Unexamined Published Japanese Patent Application Nos. 21004/1980, 145530/1979, 152225/1977, 20327/1978, 17729/1978 and 6321/1980; and Japanese Patent Publication Nos. 12337/1979 and 31625/1973.

The magenta coupler of the present invention and the antioxidant preferably used in combination therewith may be incorporated in an emulsion by any known conventional method. One illustrative method will proceed as follows: the magenta couplers of the present invention taken singly or in combination are dissolved in high-boiling point organic solvents such as phthalic acid esters (e.g., dibutyl phthalate and dioctyl phthalate), phosphoric acid esters (e.g., tricresyl phosphate, triphenyl phosphate and trioctyl phosphate) and N,N-dialkyl-substituted amides (e.g., N,N-diethyllaurinamide), or low-boiling point organic solvents such as ethyl acetate, butyl acetate and butyl propionate (the high- and low-boiling point organic solvents may be used as mixtures if required); the solution is mixed with an aqueous solution of gelatin containing a surfactant; the mixture is then emulsified by a high-speed mixer, colloid mill or an ultrasonic disperser to make a dispersion, which is subsequently added to a silver halide to prepare a silver halide emulsion suitable for use in the present invention.

The gelatin used in the present invention may be gelatin. derivatives such as acylated gelatin, guanidylated gelatin, carbamylated gelatin, cyanoethanolated gelatin and esterified gelatin.

In accordance with the present invention, layers positioned above the silver halide emulsion layer containing the magenta coupler of the present invention with respect to the base have a gelatin content of 3 g/m$^2$ or more, preferably 3–20 g/m$^2$, more preferably 3–10 g/m$^2$. The amount of gelatin present between the base and the emulsion layer containing the magenta coupler of the present invention is preferably not more than 3.5 g/mm$^2$.

The oxygen permeability of the base used in the present invention may be measured by any known method, for example, the one specified in ASTM D-1434.

Any material may be used as the base for the photographic material of the present invention if it has an oxygen permeability of no more than 2.0 ml/m$^2$.hr.atm. Preferred oxygen permeability values are no more than 1.0 ml/m$^2$.hr.atm and this requirement may be satisfied by plastic films.

Polymers that may be used as plastic film formers include polyesters (e.g., polyethylene terephthalate), homopolymers and copolymers of monomers such as vinyl alcohol, vinyl chloride, vinyl fluoride and vinyl acetate, and homopolymers and copolymers of such monomers as acetyl cellulose, acrylonitrile, alkyl esters of acrylic acid, alkyl esters of methacrylic acid, methacrylonitrile, alkyl vinyl ethers and polyamides. A particularly preferred polymer is a polyester because the oxygen permeability of the polyester film is non-dependent on humidity and maintains the same value whether it is in a humid or dry atmosphere.

In order to be provided with reflectivity, the base used in the present invention may incorporate a white pigment. Alternatively, a transparent base material may be coated with a hydrophilic colloidal layer containing a white pigment. Inorganic and/or organic white pigments may be used, and inorganic white pigments are preferred. Illustrative inorganic white pigments include alkali metal sulfates such as barium sulfate, alkaline earth metal carbonates such as calcium carbonate, siliceous materials such as finely divided silicic acid and synthetic silicates, as well as calcium silicate, alumina, alumina hydrates, titanium oxide, zinc oxide, talc and clay. Preferred white pigments are barium sulfate, calcium carbonate and titanium oxide, and barium sulfate is particularly preferred.

If these white pigments are incorporated in the plastic film bases, the pigment content is preferably in the range of 5–50 wt % of the weight of the film forming polymer.

The photographic material of the present invention is suitable for direct viewing and the reflective base of the material preferably has a visually white color. Whiteness may be expressed in terms of L*a*b* that is determined by the method specified in JIS Z-8722 and Z-8730. A preferred L* value is at least 80%m with 90% being more preferred. Preferred a* and b* values are in the ranges of from −1.0 to +1.0 and from −2.0 to −5.0, respectively.

The reflective base used in the present invention is preferably glossy. The degree of gloss may be expressed in terms of the value determined by the method specified in JIS Z-8741. A preferred gloss value is at least 40%, with 60% upward being more preferred.

From a handling viewpoint, the reflective base used in the present invention should have a suitable rigidity. Rigidity may be expressed in terms of values determined by the method specified in TAPPI T-489. Preferred values are at least 8 g for both LD (longitudinal rigidity) and TD (transversal rigidity).

The thickness of the reflective base is not critical for the purposes of the present invention so long as its oxygen permeability is no more than 2.0 ml/m$^2$.hr.atm. As a guide, the base preferably has a thickness of 10–300 μm, more preferably 50–200 μm, as measured by the method specified in JIS P-8118.

The silver halide photographic material of the present invention is such that at least one silver halide emulsion layer containing the magenta coupler defined herein before is formed on the base also defined hereinbefore. The other requirement is that layers positioned above said silver halide emulsion layer with respect to the base have a gelatin content of no less than 3 g/m$^2$. If these requirements are met, any layers may be positioned above said silver halide emulsion layer with respect to the base, and there is no particular limitation on the number of silver halide emulsion layers and non-sensitive layers to be formed, or on the order in which they are arranged. However, it is preferable that, of the silver halide emulsion layers, the magenta dye image forming layer containing the magenta coupler defined hereinabove be positioned nearest the base or positioned as a second layer from the base.

Two preferred specific layer arrangements for the silver halide photographic material of the present invention if it is for multi-color formation are shown below: the base defined hereinabove, which is coated, in order from said base, with a yellow dye image forming layer, an intermediate layer, a magenta dye image forming layer containing the magenta coupler defined herein before, an intermediate layer containing a UV absorber, a cyan dye image forming layer, an intermediate layer containing a UV absorber, and a protective layer; and the base defined hereinabove, which is coated, in order from said base, with a magenta dye image forming layer containing the magenta coupler defined hereinbefore, an intermediate layer, a yellow dye image forming layer, an intermediate layer containing a UV absorber, a cyan dye image forming layer, an intermediate layer containing a UV absorber, and a protective layer.

The silver halide photographic material of the present invention may be, for example, color negative and positive films and color photographic paper, but particularly when color photographic paper for viewing the printed color image directly is used, the effect of the present invention is produced strikingly.

The silver halide photographic material of the present invention including such color photographic paper may be either for monochrome or multicolor use. The silver halide photographic material for multicolor use has a structure such that silver halide emulsion layers usually containing magenta, yellow and cyan couplers, respectively, as photographic couplers, and nonsensitive layers are superimporsed in appropriate number of layers and in appropriate sequence on the support in order to effect subtractive color reproduction, but such number of layers and sequence may be changed appropriately according to use object.

The silver halide emulsion used in the silver halide photographic material of the present invention may be selected from among the silver halides commonly used in silver halide photography, such as silver bromide, silver chloride, silver iodobromide, silver chlorobromide and silver chloroiodobromide.

The silver halide grains used in the silver halide emulsions of the present invention may be those obtained by any of the acid method, neutral method, and ammoniacal method. These grains may be grown at one time or may be grown after preparing seed grains. The method of preparing seed grains and the method of growing them may be the same or different.

In preparing the silver halide emulsion, halide ions and silver ions may admixed at the same time, or either one may be admixed with the other one present in the emulsion. Also, while considering the critical speed of growth of silver halide crystals, halide ions and silver ions may be added one by one or at the same time into a mixing bath while controlling the pH and pAg in said bath to grow the crystals.

In preparing the silver halide of the present invention, it is possible, by using a silver halide solvent optionally, to control the grain size, shape, grain size distribution and speed of growth of the silver halide grains.

The silver halide grains to be used in the silver halide emulsions of the present invention may have metal ions incorporated inside the grains and/or in the grain surfaces in the course of forming and/or growing the grains by using cadmium salt, zinc salt, lead salt, thallium salt, iridium salt or its complex salt, rhodium salt or its complex salt, or iron salt or its complex salt. Said grains may also be placed in an appropriate reduction atmosphere to have reduction-sensitized specks imparted inside the grains and/or into the grain surfaces.

The silver halide emulsions of the present invention may be removed of unnecessary soluble salts after completion of the growth of the silver halide grains or may be left as they are containing such salts. In removing said salts; the method described in "Research Disclosure No. 17643" may be used.

The silver halide grains to be used in the silver halide emulsions of the present invention may have a homogeneous structure throughout the crystal, or the structure of the core may be different from that of the shell. These silver halide grains may be of the surface type where latent images are predominantly formed on the grain surface or of the internal type where latent images are formed within the grain.

The silver halide grains may be regular crystals or irregular crystals such as inspherical or plane form. They may have any proportions of (100) and (111) planes, and may also be in composite form of these crystals or may be admixed with various crystal grains.

The silver halide emulsion of the present invention may be a mixture of two or more silver halide emulsions prepared separately.

The silver halide emulsion of the present invention is chemically sensitized by an ordinary method, such as the sulfur sensitization using a compound containing sulfur capable of reaction with silver ions or using active gelatin, the selenium sensitization using a selenium compound, the reduction sensitization using reducible material, or the noble metal sensitization using gold and other noble metal compounds. Such methods may be used each independently or in combination.

The silver halide emulsion of the present invention may be spectrally sensitized by suitably selected sensitizing dye in order to provide sensitivity for the desired spectral wavelength regions. A variety of spectral sensitizing dyes may be used either individually or in combination. The silver halide emulsion may contain, together with the sensitizer, a dye which itself has no spectral sensitizing action or a supersensitizer which, being a compound which substantially does not absorb visible light, strengthens the sensitizing action of the sensitizer.

In order to prevent the occurrence of fog and/or keep the photographic properties stable, in the course of preparing the photographic material, in storage or in processing thereof, a compound known in the photographic industry as an antifoggant or stabilizer may be added to the silver halide emulsion of the present invention in the course of chemical ripening and/or upon completion of chemical ripening and/or after completion of chemical ripening but before coating of the silver halide emulsion.

The binder (or protective colloid) advantageously used in the silver halide emulsion of the present invention is gelatin, but other hydrophilic colloids such as gelatin derivative, glaft polymer of gelatin with other polymer, protein, sugar derivative, cellulose derivative, and synthesized hydrophillic polymer may be used.

The photographic emulsion layer and other hydrophilic colloidal layer(s) of the photographic material using the silver halide emulsion of the present invention are hardened by using hardeners either alone or in combination that bridge the binder (or protective colloid) molecules to enhance the film strength. The hardener is desirably added in such an amount as is capable of hardening the photographic material to the extent that there is no need to add the hardener in the processing solution, but such hardener may be added in the processing solution.

A plasticizer can be added with a view to enhancing the flexibility of the silver halide emulsion layer and/or other hydrophilic colloidal layer(s) of the photographic material using the silver halide emulsion of the present invention.

A water-insoluble or hardly soluble synthesized polymer latex can be incorporated for the purpose of improving the dimensional stability of the photographic emulsion layer and other hydrophilic colloidal layer(s) of the photographic material using the silver halide emulsion of the present invention.

In the emulsion layer of the silver halide color photographic material of the present invention, a dye-forming coupler is used which forms a dye upon coupling reaction with the oxidized product of an aromatic primary amine developing agent (e.g., p-phenylenediamine derivative or aminophenol derivative) in the color developing processing. The color-forming coupler is usually selected so that a dye is formed which absorbs the spectral wavelength sensitive to the emulsion layer containing said dye; that is, a yellow dye-forming coupler is used in the blue-sensitive emulsion layer, a magenta dye-forming coupler in the green-sensitive emulsion layer, and a cyan dye-forming coupler in the red-sensitive emulsion layer. However, the respective couplers may be used in different combination from those mentioned above according to the object.

Hydrophobic compounds such as dye-forming coupler that need not be adsorbed onto the silver halide crystal surfaces can be dispersed into the emulsion by means of solid dispersion, latex dispersion or oil-in-water drop type emulsion dispersion. Such dispersion method can be appropriately selected according to the chemical structure and the like of the hydrophobic compounds. The oil-in-water drop type emulsion dispersion method may be any conventional method of dispersing hydrophobic additives such as coupler, which usually comprises dissolving such hydrophobic additives in a high-boiling organic solvent having a boiling point higher than about 150° C. by optionally using low-boiling and/or water-soluble organic solvents together, then emulsion-dispersing the dissolved hydrophobic additives by using a surfactant in a hydrophilic binder such as aqueous gelatin solution with such means of dispersion as a stirrer, homogenizer, colloid mill, flow-jet mixer or ultrasonic disperser, and thereafter adding the resulting dispersion into the hydrophilic colloidal layer. In that case, the step of removing the low-boiling organic solvent after or simultaneously with dispersion may be added.

Dispersion aids used in dissolving hydrophobic compounds in a low-boiling solvent alone or mixed with a high-boiling solvent and dispersing the dissolved hydrophobic compounds into water by using a mixer or ultrasonic disperser include anionic surfactants, nonionic surfactants and cationic surfactants.

Anti-color foggants may be used in order to prevent occurrence of color stain, deterioration of sharpness and coarse graininess due to moving of the oxidized product of a developing agent or the electron transporting agent between the emulsion layers (the same color-sensitive layers and/or different color-sensitive layers) of the color photographic material of the present invention.

The anti-color foggants may be incorporated in the emulsion layer itself or in the intermediate layer provided between adjacent emulsion layers.

Image stabilizers can be incorporated in the color photographic material using silver halide emulsion layers of the present invention in order to prevent deterioration of color images.

The hydrophilic colloidal layers such as protective layer and intermediate layer of the photographic material of the present invention may have incorporated therein UV absorbers in order to prevent occurrence of fogging due to discharge resulting from the photographic material being charged by its friction or the like, or to prevent deterioration of images due to UV light.

The color photographic material using a silver halide emulsion of the present invention can be provided with auxiliary layers such as filter layer, anti-halation layer and/or anti-irradiation layer. These auxiliary layers and/or the emulsion layers may have incorporated therein flowing out of the color photographic material or being bleached during the color developing processing.

Matting agents can be incorporated in the silver halide emulsion layers and/or other hydrophilic colloidal layers of the silver halide photographic material using a silver halide emulsion of the present invention, with a view to reducing the surface gloss to render writing in pencil possible and to preventing adhesion of photographic materials to each other.

The light-sensitive material using the silver halide emulsion of the present invention may contain a lubricant that is capable of reducing its sliding friction.

The light-sensitive material may also contain an antistat for the purpose of preventing static buildup. The antistat may be incorporated in an antistatic layer on the side of the support where no emulsion layer is formed. Alternatively, the antistat may be incorporated in an emulsion layer and/or a protective layer other than an emulsion layer which is on the side of the support where said emulsion layer is formed.

Photographic emulsion layers and/or other hydrophilic colloidal layers in the light-sensitive material using the silver halide emulsion of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

After optional surface treatment of the support by suitable techniques such as corona discharge, UV irradiation and flame treatment, the silver halide light-sensitive material of the present invention may be coated onto the support either directly or with one or more subbing layers formed thereon. The subbing layers are provided for improving the adhesive strength, antistatic property, dimensional stability, frictional resistance, hardness, anti-halation property, frictional characteristics and/or other characteristics of the surface of the support.

A thickener may be used in order to facilitate the coating of the photographic material using the silver halide emulsion of the present invention. Particularly useful coating techniques are extrusion coating and curtain coating, both of which will enable simultaneous application of two or more layers.

The light-sensitive material of the present invention may be exposed to electromagnetic waves in the spectral region to which the emulsion layers that make up the light-sensitive material have sensitivity. Any known light sources may be used and they include daylight (sunshine), tungsten lamps, fluorescent lamps, mercury lamps, xenon arc lamps, carbon arc lamps, xenon flash lamps, CRT flying spot, light from a variety of lasers, LED emitted light, and light emitted from fluorescent materials upon excitation by electron beams, X-rays, gamma-rays or alpha-rays.

The exposure time may range from 1 millisecond to 1 second as is usually the case with cameras. Periods shorter than 1 microsecond, such as one ranging from 100 microseconds to 1 microsecond may be employed with CRTs or xenon flash lamps. Exposure longer than 1 second would also be possible. The exposure may be continuous or intermittent.

The silver halide photographic material of the present invention may form an image by an techniques of color development that are known in the art. The color developer used to process this photographic material may contain any of the known aromatic primary amine color developing agents that are extensively used in various color photographic processes. Such developing agents include aminophenolic and p-phenylenediamine derivatives. These compounds are generally used in salt forms, such as hydrochlorides or sulfates, which are stabler than the free state. These compounds are used in concentrations that generally range from about 0.1 to about 30 g, preferably from about 1 g to about 1.5 g per liter of the color developer.

Illustrative aminophenolic developing agents include o-aminophenol, p-aminophenol, 5-amino-2-oxytoluene, 2-amino-3-oxytoluene, and 2-oxy-3-amino-1,4-dimethylbenzene.

Particularly useful primary aromatic amino color developing agents are N,N-dialkyl-p-phenylenediamine compounds wherein the alkyl or phenyl group may have a suitable substituent. Among these compounds, the following are particularly advantageous: N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, and 4-amino-N-(2-methoxyethyl)-N-ethyl-3-methylaniline-p-toluene sulfonate.

In addition to these primary aromatic amino color developing agents, the color developer used in the processing of the photographic material of the present invention may contain a variety of additives that are commonly incorporated in color developers and such additives include alkali agents (e.g., sodium hydroxide, sodium carbonate and potassium carbonate), alkali metal sulfites, alkali metal bisulfites, alkali metal thiocyanates, alkali metal halides, benzyl alcohol, water softeners and thickeners. The pH of the color developer is usually at least 7 and most generally ranges from about 10 to about 13.

After color development, the photographic material of the present invention is processed by a solution having the fixing ability. If this solution is a fixing bath, its use is preceded by a bleaching step. The bleaching agent used in the bleaching bath is a metal complex salt of an organic acid. This metal complex salt has the ability not only to oxidize metallic silver (i.e., formed as a result of development) into silver halide but also to ensure complete color formation by a color former. The structure of this metal complex salt is such that an organic acid such as an aminopolycarboxylic acid, oxalic acid or citric acid is coordinated to a metal ion such as iron, cobalt or copper. The organic acids most preferred for use in forming metal complex salts are polycarboxylic acids or aminopolycarboxylic acids. The polycarboxylic acids or aminopolycarboxylic acids may be in the form of alkali metal salts, ammonium salts or water-soluble amine salts.

Typical examples of polycarboxylic acids or aminopolycarboxylic acids are lited below:

(1) ethylenediaminetetraacetic acid;
(2) nitrilotriacetic acid;
(3) iminodiacetic acid;
(4) ethylenediaminetetraacetic acid disodium salt;
(5) ethylenediaminetetraacetic acid tetra (trimethylammonium) salt;
(6) ethylenediaminetetraacetic acid tetrasodium salt; and
(7) nitrilotriacetic acid sodium salt.

In addition to metal complex salts of these organic acids which are used as bleaching agents, the bleaching bath used in processing the color photographic material of the present invention may contain a variety of additives, and preferred additives are rehalogenating agents such as alkali or ammonium halides (e.g., potassium bromide, sodium bromide, sodium chloride and ammonium bromide), metal salts and chelating agents. Any other additives that are conventionally incorporated in bleaching baths may also be used and they include pH buffers (e.g., borate, oxalate, acetate, carbonate and phosphate salts), alkylamines and polyethylene oxides.

The fixing bath and bleach-fixing bath may also contain one or more pH buffers that are selected from among sulfites (e.g., ammonium sulfite, potassium sulfite, ammonium bisulfite, potassium bisulfite, sodium bisulfite, ammonium metabisulfite, potassium metabisulfite, and sodium metabisulfite), and a variety of acids or salts (e.g., boric acid, borax, sodium hydroxide, potassium hydroxide, sodium carbonate, potassium carbonate, sodium bicarbonate, sodium bisulfite, potassium bicarbonate, acetic acid, sodium acetate and ammonium hydroxide).

If the photographic material of the present invention is processed in a bleach-fixing bath as it is supplied with a blix replenisher, thiosulfates, thiocyanates, sulfites or other salts may be incorporated either in the bleach-fixing bath or in the replenisher that is fed to said blix bath.

In order to increase the activity of the bleach-fixing bath used in processing the photographic material of the present invention, air or oxygen may be blown into a tank containing the bleach-fixing bath or its replenisher. Alternatively, a suitable oxidant such as hydrogen peroxide, bromate or persulfate may be added into the tank.

ADVANTAGES OF THE INVENTION

If the present invention is applied to a color photographic material for prints, a magenta dye having superior spectral absorption characteristics is formed, bright dye images are formed that have good color tone and a broad color reproduction region, and the magenta dye has an improved light fastness.

Working Examples

The advantages of the present invention are hereunder described in greater detail by reference to working examples which are given here for illustrative purposes only and are by no means intended as limiting the invention.

EXAMPLE 1

Coating solutions having the composition shown in Tables 1 to 3 were successively coated onto a base to prepare multi-layered silver halide photographic materials.

TABLE 1

| Layer | Composition |
|---|---|
| 7th (protective layer) | gelatin (for its amount, see Table 2) |
| 6th (3rd intermediate layer) | gelatin (for its amount, see Table 2) |
| | UV absorber, UV-1 (0.2 g/m$^2$) |
| | UV-2 (0.1 g/m$^2$) |
| | anti-stain agent, AS-1 (0.02 g/m$^2$) |
| | high-boiling point solvent, |
| | dinonyl phthalate (0.2 g/m$^2$) |
| 5th (red-sensitive layer) | gelatin (for its amount, see Table 2) |
| | AgClBr emulsion with 70 mol % AgBr (0.25 g/m$^2$) |
| | cyan coupler, C-1/C-2 (0.4 mol per silver halide) |
| | anti-stain agent, AS-1 (0.01 g/m$^2$) |
| | high-boiling point solvent, |
| | dioctyl phthalate (0.2 g/m$^2$) |
| 4th (2nd intermediate layer) | gelatin (for its amount, see Table 2) |
| | UV absorber, UV-1 (0.5 g/m$^2$) |
| | UV-2 (0.2 g/m$^2$) |
| | anti-stain agent, AS-1 (0.03 g/m$^2$) |
| | high-boiling point solvent, |
| | dinonyl phthalate (0.3 g/m$^2$) |
| 3rd (green-sensitive layer) | gelatin (1.5 g/m$^2$) |
| | AgClBr emulsion with 70 mol % AgBr (0.35 g/m$^2$) |
| | magenta coupler No. 17 (0.4 g/m$^2$) |
| | anti-stain agent, AS-1 (0.01 g/m$^2$) |
| | high-boiling point solvent, |
| | dioctyl phthalate (0.25 g/m$^2$) |
| 2nd (1st intermediate layer) | gelatin (1.0 g/m$^2$) |
| | anti-stain agent, AS-1 (0.07 g/m$^2$) |
| | high-boiling point solvent, |
| | diisodecyl phthalate (0.04 g/m$^2$) |
| 1st (blue-sensitive layer) | gelatin (2.0 g/m$^2$) |
| | AgClBr emulsion with 90 mol % AgBr (0.3 g/m$^2$) |
| | yellow coupler, Y-1 (0.8 g/m$^2$) |
| | anti-stain agent, AS-1 (0.02 g/m$^2$) |
| | high-boiling point-solvent, |
| | dinonyl phthalate (0.3 g/m$^2$) |
| base | See Table 2. |

Yellow Coupler Y-1

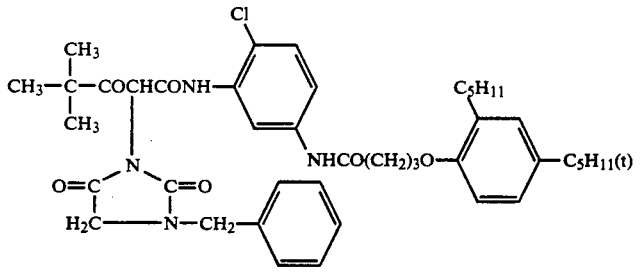

Cyan coupler C-1

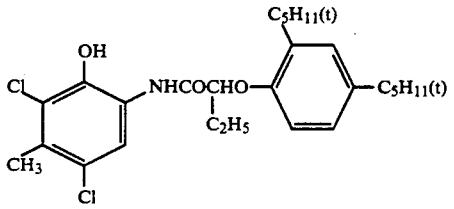

Cyan coupler C-2

TABLE 1-continued

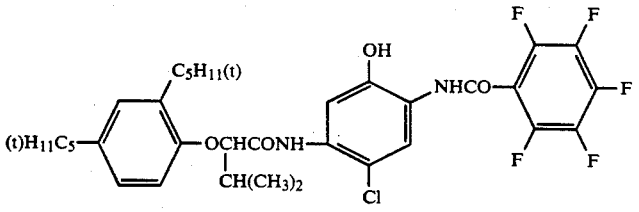

UV absorber UV-1

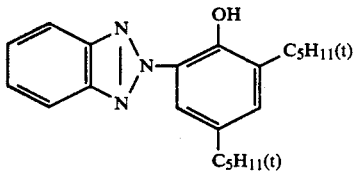

UV absorber UV-2

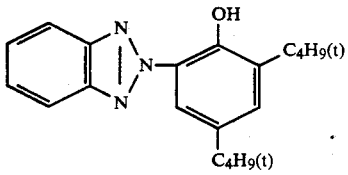

Anti-stain agent AS-1

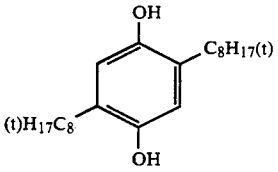

TABLE 2

| Sample No. | Base* | $O_2$ permeability (20° C., dry) ml/m$^2$ · hr · atm | Thickness μm | Gelatin content in layers 4th | 5th | 6th | 7th | sum (4 + 5 + 6 + 7) | Light fastness of magenta dye image | Remarks** |
|---|---|---|---|---|---|---|---|---|---|---|
| 1 | PE | 400 | 200 | 1.3 | 1.0 | 0.7 | 1.0 | 4.0 | 0.21 | B |
| 2 | TAC | 40 | 150 | 1.3 | 1.0 | 0.7 | 1.0 | 4.0 | 0.24 | B |
| 3 | PP | 20 | 150 | 1.3 | 1.0 | 0.7 | 1.0 | 4.0 | 0.25 | B |
| 4 | PET | 0.3 | 150 | 1.3 | 1.0 | 0.7 | 1.0 | 4.0 | 0.51 | A |
| 5 | PET | 0.6 | 75 | 1.3 | 1.0 | 0.7 | 1.0 | 4.0 | 0.49 | A |
| 6 | PVC/PCDC | 0.5 | 150 | 1.3 | 1.0 | 0.7 | 1.0 | 4.0 | 0.50 | A |
| 7 | PE | 400 | 200 | 0.8 | 0.6 | 0.4 | 0.2 | 2.0 | 0.20 | B |
| 8 | PE | 400 | 200 | 1.0 | 1.0 | 0.6 | 0.4 | 3.0 | 0.22 | B |
| 9 | PE | 400 | 200 | 1.5 | 1.5 | 1.0 | 1.0 | 5.0 | 0.25 | B |
| 10 | PET | 0.3 | 150 | 0.8 | 0.6 | 0.4 | 0.2 | 2.0 | 0.27 | B |
| 11 | PET | 0.3 | 150 | 1.0 | 1.0 | 0.6 | 0.4 | 3.0 | 0.48 | A |
| 12 | PET | 0.3 | 150 | 1.5 | 1.5 | 1.0 | 1.0 | 5.0 | 0.53 | A |

*For the composition of each base, see Table 3.
**A, sample of the present invention; B, comparative sample

TABLE 3

| Symbol | Composition |
|---|---|
| PE | paper base laminated on both sides with 25 μm of polyethylene layer (containing 15 g of $TiO_2$ in 100 g of polyethylene) |
| TAC | triacetyl cellulose film base containing 20 g of barium sulfate in 100 g of triacetyl cellulose |
| P.P | polypropylene film base containing 20 g of barium sulfate in 100 g of polypropylene |
| PET | polyester film base containing 20 g of barium sulfate in 100 g of polyethylene terephthalate |
| PVC/PVCD | resin film base containing 20 g of barium sulfate in 100 g of vinyl chloride-vinylidene |

TABLE 3-continued

| Symbol | Composition |
|---|---|
| | chloride copolymer |

The samples prepared in accordance with the specifications shown above were exposed to green light through an optical wedge and processed by the scheme shown below, whereby magenta dye images were formed. In order to evaluate the light fastness of the magenta dye images formed in the samples, they were given an exposure of 45,000 1× under a xenon fadeometer for 100 hours and the residual density of each image relative to the initial value of 1.0 was measured. The results are shown in Table 2.

| Processing scheme | | | |
|---|---|---|---|
| | Steps | Temperature (°C.) | Period |
| (1) | color development | 33 | 3 min, 30 sec |
| (2) | bleach-fixing | 38 | 1 min, 30 sec |
| (3) | washing | 25–30 | 3 min |
| (4) | drying | 75–80 | ca. 2 min |

Compositions of processing solutions:

| Color development tank solution | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidoethyl)-aniline sulfate | 5.5 g |
| Brightener (4,4'-diaminostilbenzo-sulfonic acid derivative) | 1.0 g |
| Potassium hydroxide | 2.0 g |
| Water to make | 1,000 ml |
| pH adjusted to | 10.20 |
| **Bleach-fixing tank solution** | |
| Ethylenediaminetetraacetic acid iron (III) ammonium dihydrate | 60 g |
| Ethylenediaminetetraacetic acid | 3 g |
| Ammonium thiosulfate (70% sol.) | 100 ml |
| Ammonium sulfite (40% sol.) | 27.5 ml |
| pH adjusted to 7.1 with potassium carbonate or glacial acetic acid | |
| Water added to make | 1,000 ml |

The data in Table 2 show that the magenta dye images formed on Samples Nos. 4, 5, 6, 11 and 12 wherein the bases had oxygen permeability values of no more than 2.0 ml/m$^2$.hr.atm and the total amount of gelatin in the layers above the 3rd layer was no less than 3 g/m$^2$ had a significantly improved light fastness over comparative sample Nos. 1, 2, 3 and 7 to 10. It is also clear from Table 2 that no significant improvement in light fastness could be obtained even when either the oxygen permeability of the base or the total amount of gelatin in the layers above the 3rd layer was in accordance with the present invention.

EXAMPLE 2

Samples having the layer arrangements shown in Table 4 were prepared as in Example 1 and subjected to a light fastness test as in Example 1. The results are shown in Table 5.

TABLE 4

| Sample No. | Layer arrangement |
|---|---|
| 13 | same as sample No. 4 except that antioxidant, AO-1 (0.2 g/m$^2$) was incorporated in the 3rd layer |
| 14 | same as sample No. 4 except that antioxidant, AO-2 (0.2 g/m$^2$) was incorporated in the third layer |
| 15 | same as sample No.4 except that the order of the first and third layers was reversed |
| 16 | same as sample No. 13 except that the order of the first and third layers was reversed. |

Antioxidant AO-1

TABLE 4-continued

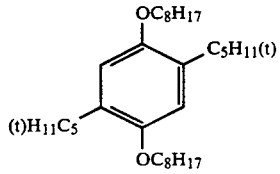

Antioxidant AO-2

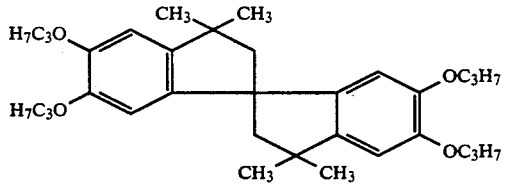

TABLE 5

| Sample No. | Light fastness of magenta dye image | Remarks |
|---|---|---|
| 4 | 0.51 | A |
| 13 | 0.58 | A |
| 14 | 0.57 | A |
| 15 | 0.58 | A |
| 16 | 0.59 | A |

A: sample of the present invention

As is clear from Table 5, the light fastness of magenta dye images could be further improve either by incorporating an antioxidant in the 3rd layer containing the magenta coupler of the present invention or by reversing the order of the first and third layers.

EXAMPLE 3

Samples having the composition of sample No. 1 or 4 were prepared except that the magenta coupler of the present invention incorporated in the 3rd layer was replaced by those listed in Table 6. The samples so prepared were then subjected to a light fastness that as in Example 1. The results are shown in Table 6.

TABLE 6

| Sample No. | Base | $O_2$ permeability ml/m$^2$ · hr · atm | Magenta coupler | Light fastness of magenta dye image | Remarks |
|---|---|---|---|---|---|
| 1 | PE | 400 | 17 | 0.21 | B |
| 17 | PE | 400 | 9 | 0.19 | B |
| 18 | PE | 400 | 27 | 0.20 | B |
| 19 | PE | 400 | 36 | 0.20 | B |
| 20 | PE | 400 | 57 | 0.24 | B |
| 21 | PE | 400 | 61 | 0.23 | B |
| 4 | PET | 0.3 | 17 | 0.51 | A |
| 22 | PET | 0.3 | 9 | 0.48 | A |
| 23 | PET | 0.3 | 27 | 0.52 | A |
| 25 | PET | 0.3 | 57 | 0.59 | A |
| 26 | PET | 0.3 | 61 | 0.55 | A |

A: sample of the present invention,
B: comparative sample

As is clear from Table 6, sample Nos. 4 and 22 to 26 using magenta couplers included within the scope of the present invention produced magenta dye images that were significantly improved in light fastness over comparative sample Nos. 1 and 17 to 21.

EXAMPLE 4

Sample No. 27 was prepared by substituting magenta coupler M-1 for the coupler incorporated in the third layer of sample No. 1. The light fastness of the magenta dye images formed in sample Nos. 25 and 27 was evaluated as in Example 1. The color reproduction regions in the two samples were evaluated by the method described below. The results of the two evaluations are shown in Table 7.

Evaluation of color reproduction regions

In accordance with method of color indication based on the L*u*v* colorimetric system defined in JIS Z 872 -1980, a u'-v' chromaticity diagram for L*=50 was prepared, and the color reproduction region formed by yellow, magenta and cyan color dyes was evaluated by their relative areas to obtain the overall value of evaluation. The blue reproduction region formed by cyan and magenta color dyes, the green reproduction region formed by cyan and yellow color dyes, and the red reproduction region formed by magenta and yellow color dyes were evaluated by their relative values.

Magenta coupler, M-1

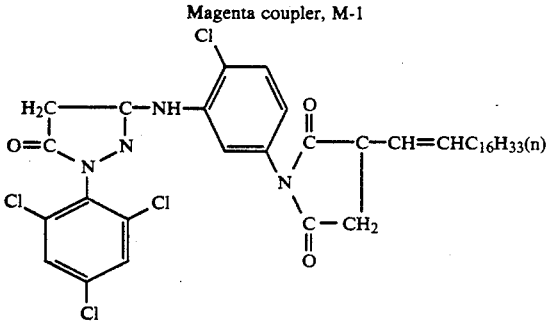

TABLE 7

| Sample No. | Color reproduction regions overall | blue | green | red | Light fastness of magenta dye image | Remarks |
|---|---|---|---|---|---|---|
| 27 | 100 | 100 | 100 | 100 | 0.61 | B |
| 28 | 100 | 122 | 100 | 105 | 0.59 | A |

A: sample of the present invention,
B: comparative sample.

As Table 7 shows, the light fastness of the magenta dye image formed in sample No. 25 of the present invention compared favorably with the magenta dye formed in comparative sample No. 27. Sample No. 25 had expanded color reproduction regions with respect to blue and red colors and to the overall value, with the improvement in the blue reproduction region being particularly significant. It is therefore clear that the present invention enables the formation of sharp dye images over a broad color reproduction region.

What is claimed is:

1. A silver halide photographic material having at least one silver halide emulsion layer formed on a polyester film base, said base being a reflective base having an oxygen permeability of no more than 2.0 ml/m$^2$.hr.atm, at least one silver halide emulsion layer being a magenta dye forming layer containing at least one magenta coupler of Formula (II) or Formula (III); the layers positioned above said silver magenta coupler containing layer with respect to said base having a gelatin content of no less than 3 g/m$^2$;

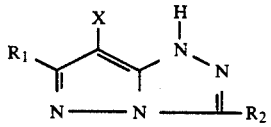

II

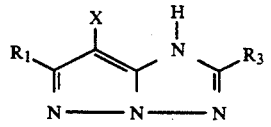

III

X represents hydrogen or a substituent capable of being eliminated upon reaction with the oxidation product of a color developing agent; $R_1$ is a substituent represented by the following Formula (IX):

formula (IX):

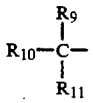

wherein each of $R_9$, $R_{10}$, and $R_{11}$ represents hydrogen, halogen, alkyl, cycloalkyl, alkenyl, cycloalkenyl, alkynyl, aryl, a heterocyclic group, acyl, sulfonyl, sulfinyl, phosphonyl, carbamoyl, sulfamoyl, cyano, a spiro-compound residue, a bridged hydrocarbon compound residue, alkoxy, aryloxy, siloxy, acyloxy, carbamoyloxy, amino, acylamino, sulfonamide, imido, ureido, sulfamoylamino, alkoxycarbonylamino, aryloxycarbonylamino, alkoxycarbonyl, aryloxycarbonyl, alkylthio, arylthio, or a heterocyclicthio group, provided that at least two of $R_9$, $R_{10}$, and $R_{11}$ are not hydrogen, and further that two of $R_9$, $R_{10}$, and $R_{11}$ may cooperate to form a saturated or unsaturated ring; and each of $R_2$ and $R_3$ represents hydrogen or a substituent.

2. A silver halide photographic material according to claim 1, wherein said magenta dye forming layer is positioned nearest the base or positioned as a second layer from the base.

3. A silver halide photographic material according to claim 2, wherein said magenta dye forming layer is positioned nearest the base.

4. A silver halide photographic material according to claim 2, wherein said magenta dye forming layer is positioned as a second layer from the base.

5. A silver halide photographic material according to claim 1, wherein the layers positioned above said magenta dye forming layer with respect to said base have a gelatin content of no less than 5 g/m$^2$.

6. A silver halide photographic material according to claim 1, wherein the layers positioned between said base and said magenta dye forming layer have a gelatin content of less than 3.5 g/m$^2$.

7. A silver halide photographic material according to claim 1 wherein $R_9$, $R_{10}$ and $R_{11}$ in said formula IX are such that two of $R_9$, $R_{10}$ and $R_{11}$ are alkyl groups, and the remaining one is a hydrogen atom.

8. A silver halide photographic material according to claim 1 wherein $R_9$, $R_{10}$ and $R_{11}$ in said formula IX are such that two of $R_9$, $R_{10}$ and $R_{11}$ are alkyl groups, and the remaining one is an alkyl group.

* * * * *